US011731255B2

(12) United States Patent
Ueda et al.

(10) Patent No.: US 11,731,255 B2
(45) Date of Patent: Aug. 22, 2023

(54) DRIVING TOOL

(71) Applicant: Koki Holdings Co., Ltd., Tokyo (JP)

(72) Inventors: Takashi Ueda, Ibaraki (JP); Koji Shioya, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 352 days.

(21) Appl. No.: 17/049,026

(22) PCT Filed: Mar. 29, 2019

(86) PCT No.: PCT/JP2019/014014
§ 371 (c)(1),
(2) Date: Oct. 20, 2020

(87) PCT Pub. No.: WO2019/208102
PCT Pub. Date: Oct. 31, 2019

(65) Prior Publication Data

US 2021/0245345 A1 Aug. 12, 2021

(30) Foreign Application Priority Data

Apr. 24, 2018 (JP) ..... 2018-083278
Nov. 30, 2018 (JP) ..... 2018-224670

(51) Int. Cl.
*B25C 1/04* (2006.01)
*B25C 1/00* (2006.01)
*B25C 1/06* (2006.01)

(52) U.S. Cl.
CPC ..... *B25C 1/047* (2013.01); *B25C 1/008* (2013.01); *B25C 1/06* (2013.01)

(58) Field of Classification Search
CPC .. B25C 1/04; B25C 1/06; B25C 1/008; B25C 1/047
See application file for complete search history.

(56) References Cited

U.S. PATENT DOCUMENTS

2015/0053736 A1* 2/2015 Pomeroy ..... B25C 5/13 227/156
2015/0174748 A1* 6/2015 Furuta ..... B25C 1/06 227/130

FOREIGN PATENT DOCUMENTS

JP 2015116616 6/2015
JP 2017064864 4/2017
(Continued)

OTHER PUBLICATIONS

"International Search Report (Form PCT/ISA/210) of PCT/JP2019/014014," dated Jun. 25, 2019, with English translation thereof, pp. 1-2.

*Primary Examiner* — Anna K Kinsaul
*Assistant Examiner* — Veronica Martin
(74) *Attorney, Agent, or Firm* — JCIPRNET

(57) ABSTRACT

This driving tool includes: a pressure accumulator (26) in which a compressible gas is accumulated; a striking part which operates in a first direction to strike a fastener with a pressure of the compressible gas; and a driving part which causes the striking part to operate in a second direction opposite to the first direction and to increase the pressure of the pressure accumulator (26). The driving tool further includes: a cylinder chamber (98) in which the compressible gas to be supplied to the pressure accumulator (26) can be contained; a holder (44) forming the pressure accumulator (26) and the cylinder chamber (98); a piston (97) which is disposed in the holder (44) and is operable to reduce the volume of the cylinder chamber (98); and a switching valve (92) capable of connecting and disconnecting the cylinder chamber (98) and the pressure accumulator (26).

13 Claims, 19 Drawing Sheets

(56) References Cited

FOREIGN PATENT DOCUMENTS

| | | |
|---|---|---|
| WO | 2011010512 | 1/2011 |
| WO | 2015037299 | 3/2015 |
| WO | 2016136632 | 9/2016 |

* cited by examiner

DRIVING TOOL

CROSS-REFERENCE TO RELATED APPLICATION

This application is a 371 application of the International PCT application serial no. PCT/JP2019/014014, filed on Mar. 29, 2019, which claims the priority benefits of Japan Patent Application No. 2018-083278, filed on Apr. 24, 2018 and Japan Patent Application No. 2018-224670, filed on Nov. 30, 2018. The entirety of each of the above-mentioned patent applications is hereby incorporated by reference herein and made a part of this specification.

TECHNICAL FIELD

The present invention relates to a driving tool equipped with a striking part that strikes a fastener.

BACKGROUND ART

In the related art, a driving tool equipped with a striking part which strikes a fastener is described in Patent Literature 1. The driving tool described in Patent Literature 1 has a housing, a motor, a power transmission part, a compressed air supply part, a striking part, and a pressure accumulator. The compressed air supply part is provided inside the housing. The compressed air supply part has a rotary compressor, a supply pipe and an electromagnetic valve. The rotary compressor is connected to the motor via a one-way clutch. The supply pipe connects the rotary compressor and the pressure accumulator. The electromagnetic valve is provided in the supply pipe. The motor is rotatable in a first direction and a second direction. The pressure accumulator is filled with compressed air.

When the motor turns in the first direction and a turning force of the motor is transferred to the striking part via the power transmission part, the striking part operates toward a top dead center, and the pressure of the pressure accumulator increases. When the striking part reaches the top dead center, the turning force of the motor is not transferred to the striking part, and the striking part operates from the top dead center to a bottom dead center under the pressure of the pressure accumulator. When the pressure of the pressure accumulator decreases, the motor turns in the second direction and the rotary compressor compresses air. The compressed air is supplied to the pressure accumulator via the electromagnetic valve.

CITATION LIST

Patent Literature

[Patent Literature 1]
Japanese Patent Laid-Open No. 2017-64864

SUMMARY OF INVENTION

Technical Problem

The inventor of the present application has recognized that, when a rotary compressor is provided in the housing, the size of the driving tool increases.

An objective of the present invention is to provide a driving tool in which an increase in size can be suppressed.

Solution to Problem

A driving tool of an embodiment has a pressure accumulator which accumulates a compressible gas, a striking part which operates in a first direction to strike a fastener with a pressure of the compressible gas, and a driving part which operates the striking part in a second direction opposite to the first direction to increase the pressure of the pressure accumulator, in which the driving tool has a pressure chamber which is capable of accommodating the compressible gas to be supplied to the pressure accumulator; a casing which forms the pressure accumulator and the pressure chamber; a movable member which is provided in the casing and capable of being operated to reduce a volume of the pressure chamber; and a switching valve which is capable of opening and closing connection between the pressure chamber and the pressure accumulator.

Advantageous Effects of Invention

An increase in size of the driving tool according to one embodiment can be suppressed.

DESCRIPTION OF EMBODIMENTS

Among several embodiments of the driving tool included in the present invention, typical embodiments will be described with reference to the drawings.

Figure 1:
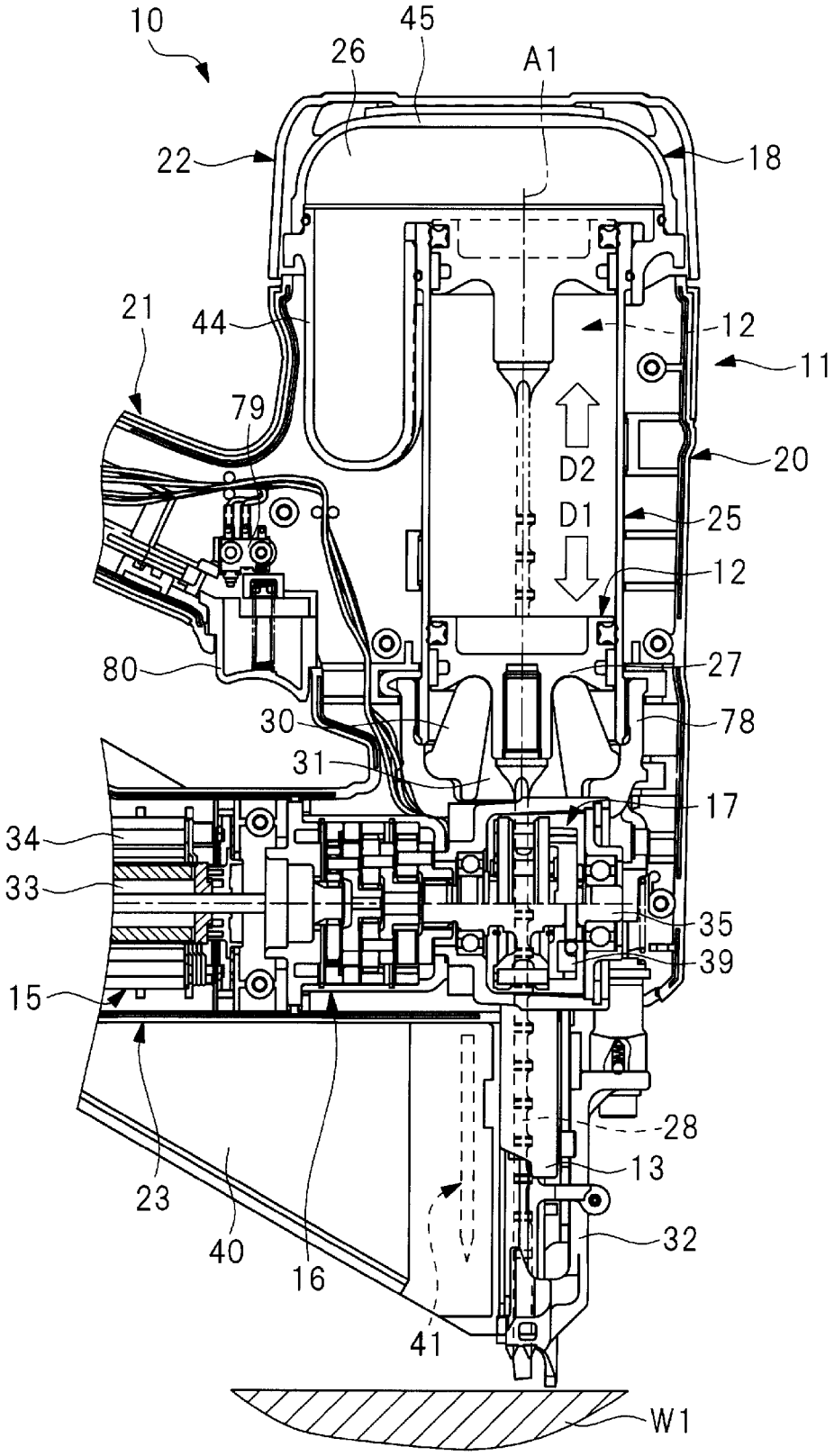
FIG. 1 is a side sectional view showing an embodiment of a driving tool included in the present invention.
Figure 2:
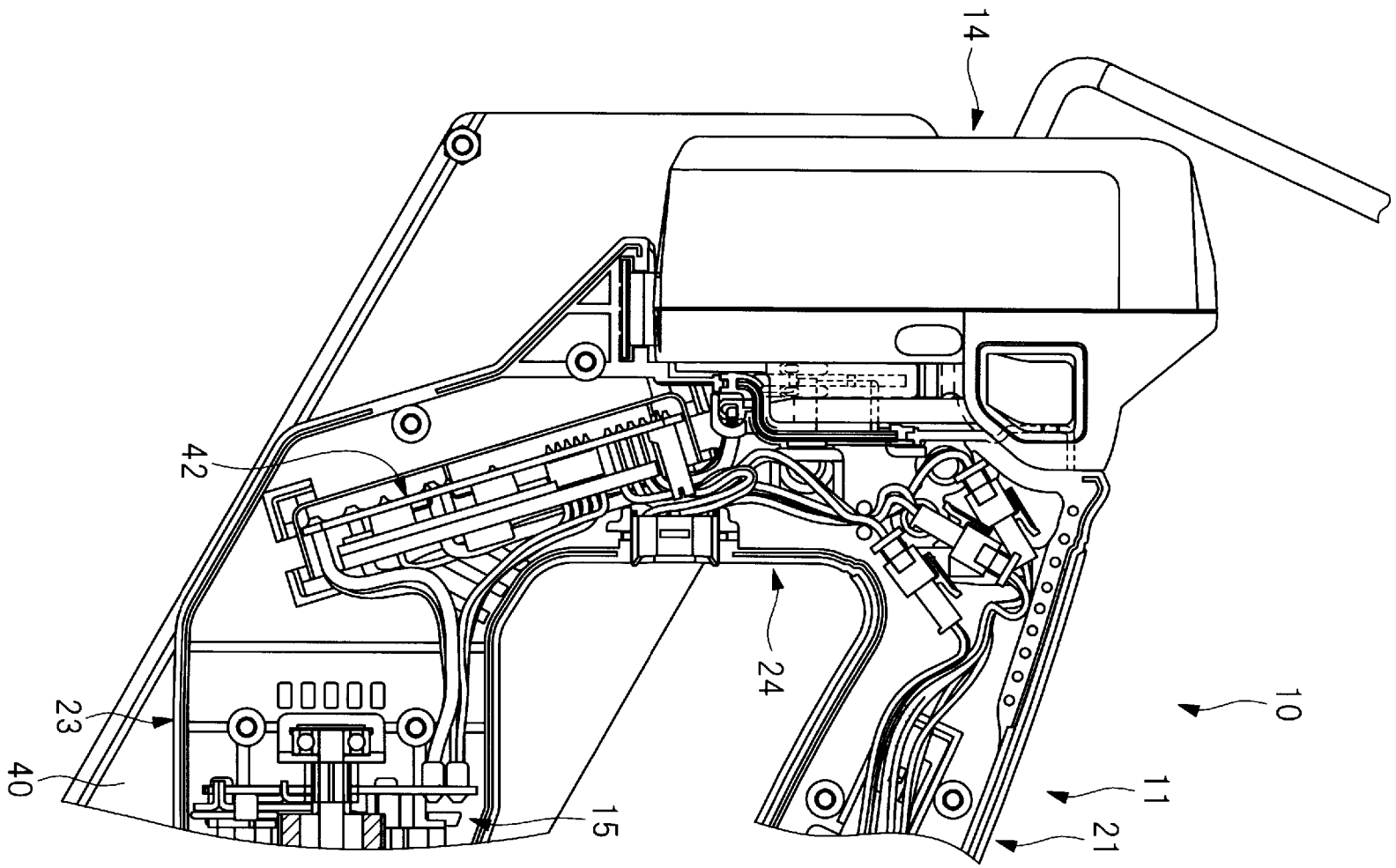
FIG. 2 is a side sectional view showing a part of the driving tool.
Figure 4:
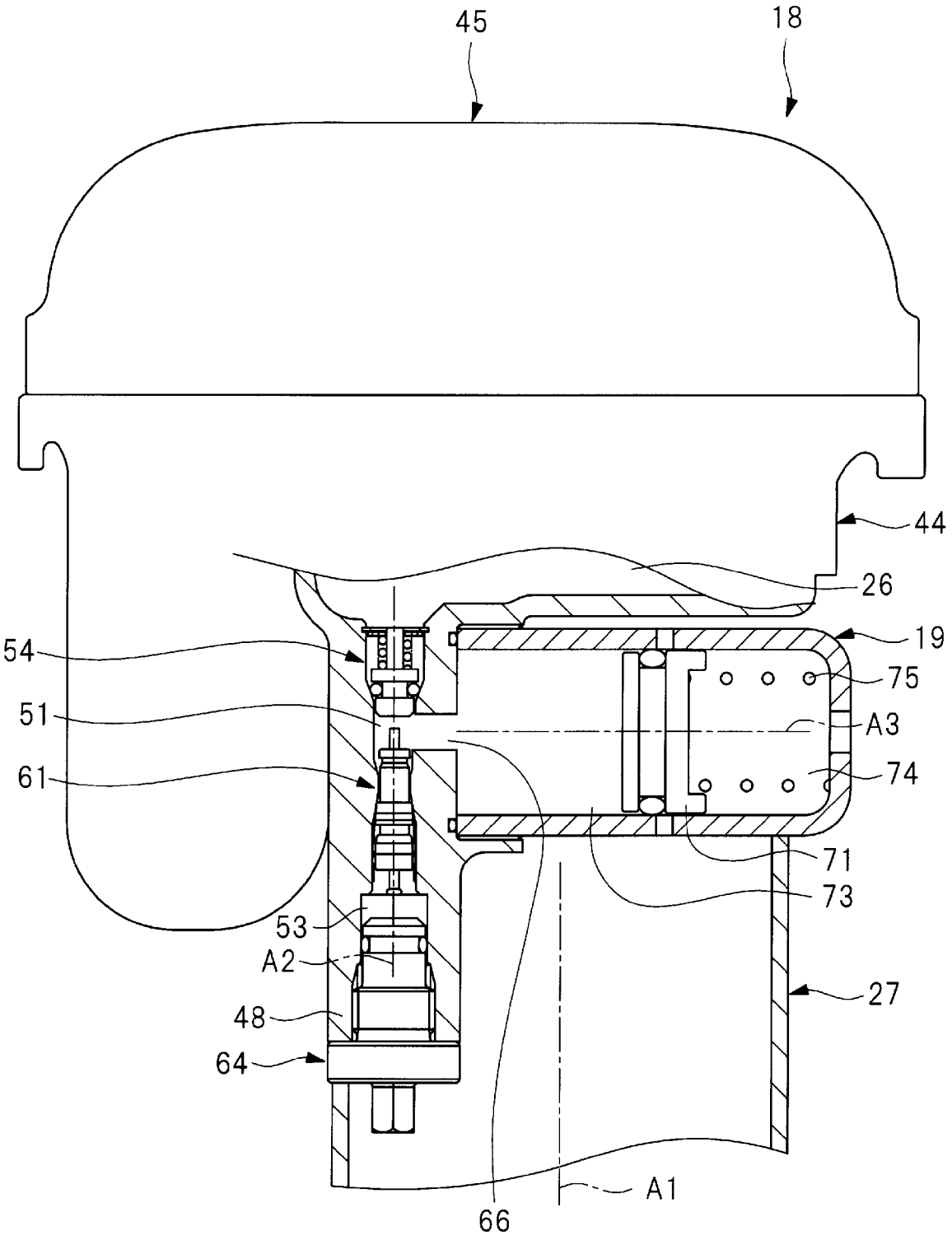
FIG. 4 is a cross-sectional view of a sub tank and a compressed air filling mechanism included in the driving tool.
Figure 5:
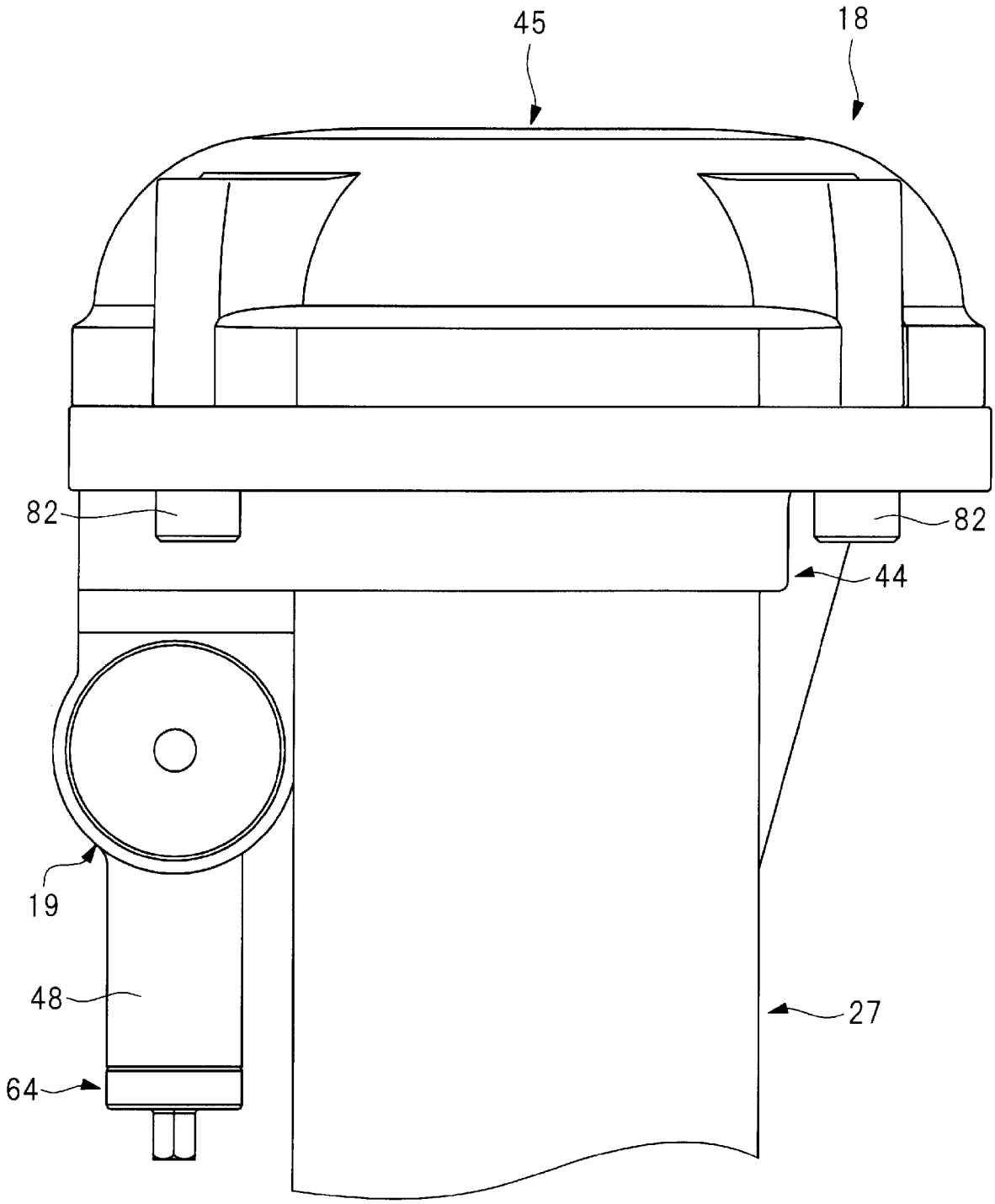
FIG. 5 is an external view of the sub tank and the compressed air filling mechanism.

The driving tool 10 shown in FIGS. 1 and 2 has a housing 11, a striking part 12, an ejection part 13, a power supply part 14, an electric motor 15, and a reduction mechanism 16. Further, the driving tool 10 has a conversion part 17 shown in FIGS. 1 and 3, and a main tank 18 and a sub tank 19 shown in FIGS. 4 and 5. The housing 11 has a cylinder case 20, a handle 21, a head cover 22, a motor case 23, and a connecting part 24. The cylinder case 20 is hollow, and the handle 21 is connected to the cylinder case 20. The motor case 23 is connected to the cylinder case 20, and the connecting part 24 is connected to the handle 21 and the motor case 23.

A cylinder 25 is accommodated in the cylinder case 20. A pressure accumulator 26 is formed in the cylinder 25 and the main tank 18. The pressure accumulator 26 is filled with a compressible gas. As the compressible gas, an inert gas may be used in addition to air. Examples of the inert gas include nitrogen gas and a rare gas. In this disclosure, an example in which the pressure accumulator 26 is filled with air will be described.

Figure 6:
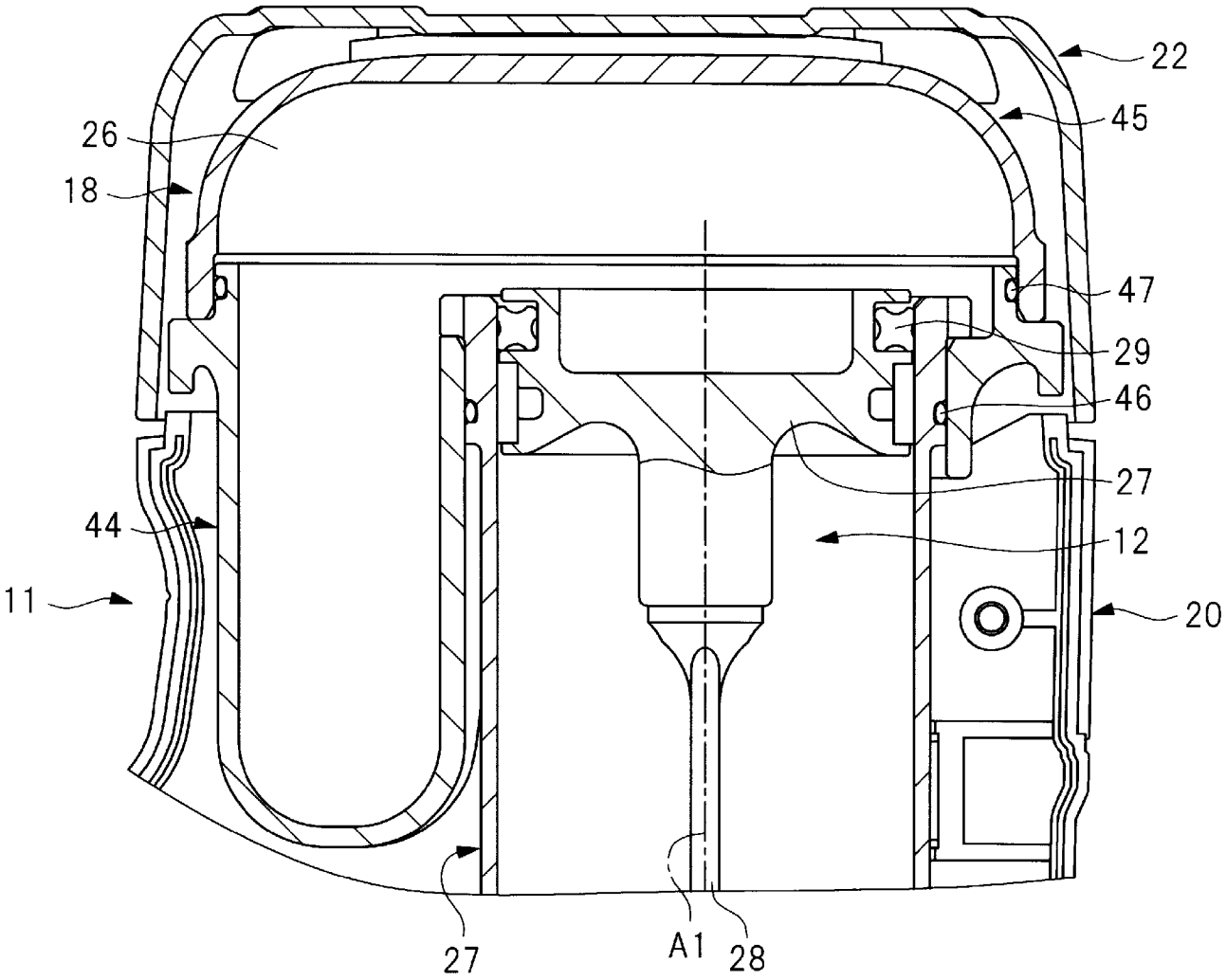
FIG. 6 is a cross-sectional view of a main tank included in the driving tool.

The striking part 12 is disposed from the inside of the housing 11 to the outside. The striking part 12 has a piston 27 and a driver blade 28 as shown in FIG. 6. The piston 27 is able to reciprocate in the cylinder 25 in a direction of a center line A1. A seal member 29 is attached to an outer peripheral surface of the piston 27. The seal member 29 has an annular shape and is made of a synthetic rubber. The seal member 29 comes into contact with an inner peripheral surface of the cylinder 25 to form a seal surface. The seal member 29 is an element that prevents the compressible gas from leaking from the pressure accumulator 26.

The driver blade 28 is made of a metal. The piston 27 and the driver blade 28 are provided as separate members, and the piston 27 and the driver blade 28 are connected to each other. The striking part 12 may be operated in the direction of the center line A1.

As shown in FIG. 1, a support part 78 is provided inside the housing 11. The support part 78 has an annular shape. A bumper 30 is supported by the support part 78. The bumper 30 may be made of a synthetic rubber or a silicon rubber. The bumper 30 has an annular shape, and the bumper 30 has a guide hole 31. The guide hole 31 is provided centering on the center line A1.

The ejection part 13 is made of a metal or a synthetic resin. The ejection part 13 supports the driver blade 28 to be movable in the direction of the center line A1. A push lever 32 is attached to the ejection part 13. The push lever 32 is movable within a predetermined range in the direction of the center line A1 with respect to the ejection part 13.

The power supply part 14 is attachable to and detachable from the connecting part 24. The power supply part 14 has a housing case and a plurality of battery cells accommodated in the housing case. The battery cell is a rechargeable and dischargeable secondary battery, and as the battery cell, a known battery cell such as a lithium ion battery, a nickel hydrogen battery, a lithium ion polymer battery or a nickel cadmium battery may be arbitrarily used.

The electric motor 15 is disposed in the motor case 23. The electric motor 15 has a rotor 33 and a stator 34. The electric motor 15 is a brushless motor, and the rotor 33 may rotate forward and backward.

The reduction mechanism 16 is provided in the motor case 23. An input element of the reduction mechanism 16 is connected to the rotor 33, and an output element of the reduction mechanism 16 is connected to a pin wheel shaft 35. The conversion part 17 is disposed in the housing 11.

Figure 3:
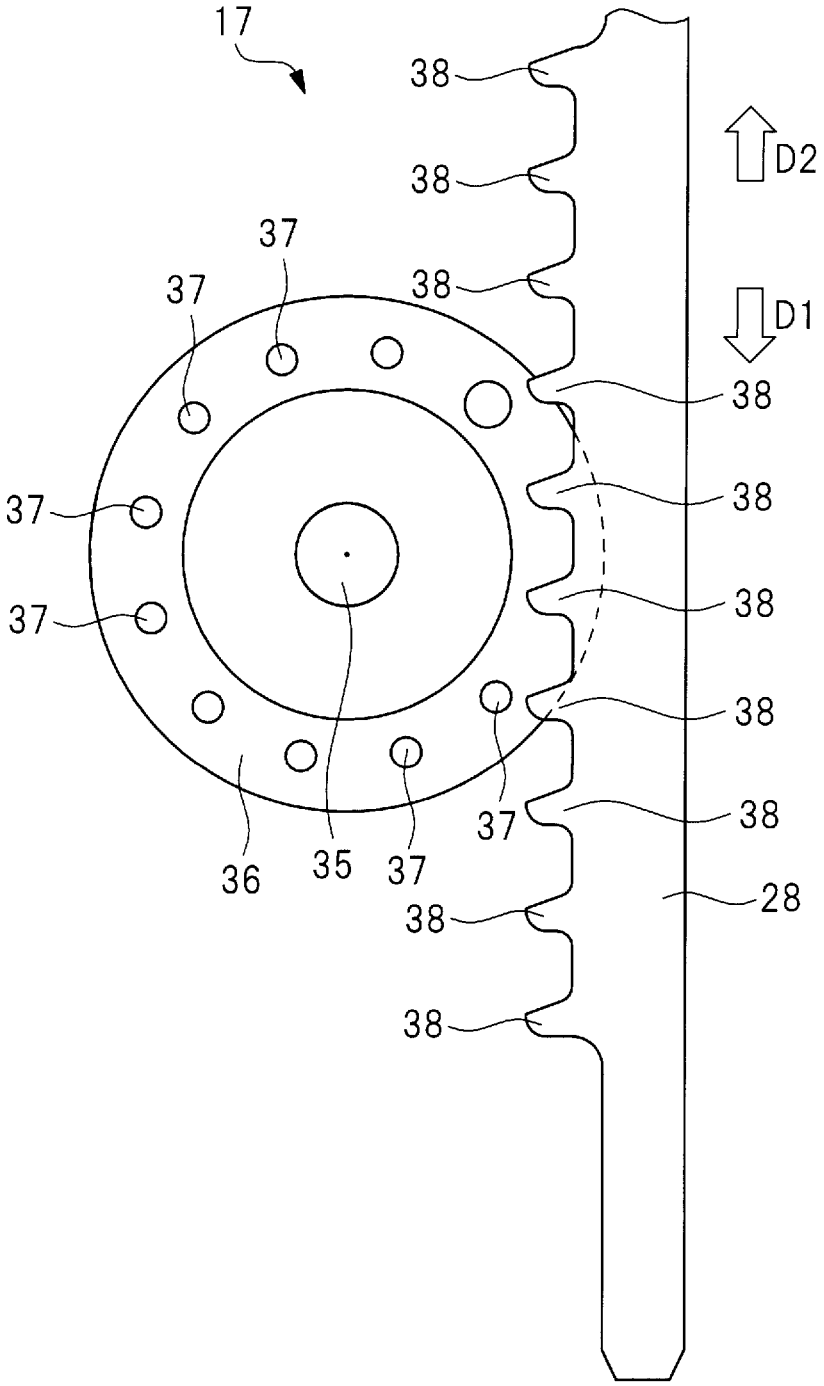
FIG. 3 is a diagram showing a conversion part included in the driving tool.

The conversion part 17 shown in FIG. 3 converts the turning force of the pin wheel shaft 35 into the operating force of the driver blade 28. The conversion part 17 has a pin wheel 36, pinion pins 37, and protrusions 38. The pin wheel 36 is fixed to the pin wheel shaft 35. The plurality of pinion pins 37 are provided in the turning direction of the pin wheel 36. The plurality of protrusions 38 are provided in a moving direction of the driver blade 28.

The pinion pins 37 may engage with and disengage from the protrusions 38. When the pinion pins 37 engage with the protrusions 38 and the pin wheel 36 turns counterclockwise in FIG. 3, the driver blade 28 moves in the second direction D2. When all the pinion pins 37 are disengaged from all the protrusions 38, the turning force of the pin wheel 36 is not transferred to the driver blade 28.

The striking part 12 shown in FIG. 1 is constantly urged in the first direction D1 by the pressure of the pressure accumulator 26. The first direction D1 and the second direction D2 are parallel to the center line A1, and the second direction D2 is opposite to the first direction D1. Movement of the striking part 12 in the first direction D1 under the pressure of the pressure accumulator 26 is defined as descent. Movement of the striking part 12 in the second direction D2 is defined as ascent.

A turning restricting mechanism 39 is provided. The turning restricting mechanism 39 allows the pin wheel shaft 35 to turn counterclockwise in FIG. 3 by the turning force when the electric motor 15 turns forward. The turning restricting mechanism 39 prevents the pin wheel shaft 35 from turning clockwise in FIG. 3 under the force of the driver blade 28 in the first direction D1.

A magazine 40 shown in FIGS. 1 and 2 is supported by the ejection part 13 and the connecting part 24. The magazine 40 accommodates nails 41. A plurality of nails 41 is connected in a row and accommodated in the magazine 40. The magazine 40 has a feeder, and the feeder sends the nails 41 in the magazine 40 to the ejection part 13.

As shown in FIG. 2, a control part 42 is provided in the housing 11, for example, in the connecting part 24. The control part 42 has a microprocessor attached to the substrate. The microprocessor has an input/output interface, a control circuit, an arithmetic processing part, and a storage part.

Further, an inverter circuit electrically connected to the power supply part 14 and the electric motor 15 is provided inside the housing 11. The inverter circuit connects and disconnects the stator 34 of the electric motor 15 and the power supply part 14. The inverter circuit is equipped with a plurality of switching elements, and the plurality of switching elements may be turned on and off singly. The control part 42 controls the turning and stopping of the electric motor 15, the turning speed of the electric motor 15, and the turning direction of the electric motor 15 by controlling the inverter circuit.

Further, a push sensor, a trigger sensor 79 and a position detection sensor are provided in the housing 11. The push sensor detects whether the push lever 32 is pressed against a driving target material W1 to output a signal. The trigger sensor 79 is provided inside the handle 21, and the trigger sensor 79 outputs a signal according to whether a manipulation force is applied to the trigger 80.

As shown in FIG. 6, the head cover 22 is attached to the cylinder case 20. The main tank 18 is disposed inside the cylinder case 20 and the head cover 22. The main tank 18 has a holder 44 and a cap 45. Both the holder 44 and the cap 45 are made of a metal, for example, a material having high thermal conductivity such as aluminum or iron. The holder 44 and the cap 45 are fixed by tightening a screw member 82 shown in FIG. 5.

The holder 44 has an annular shape, and the holder 44 is attached to the outer peripheral surface of the cylinder 25. A seal member 46 is provided between the outer peripheral surface of the cylinder 25 and the holder 44. The cap 45 is attached to the outer peripheral surface of the holder 44. A seal member 47 is provided between the inner peripheral surface of the cap 45 and the holder 44. The seal members 46 and 47 have annular shapes, and are made of a synthetic rubber. Both the seal members 46 and 47 hermetically seal the pressure accumulator 26.

Figure 7:
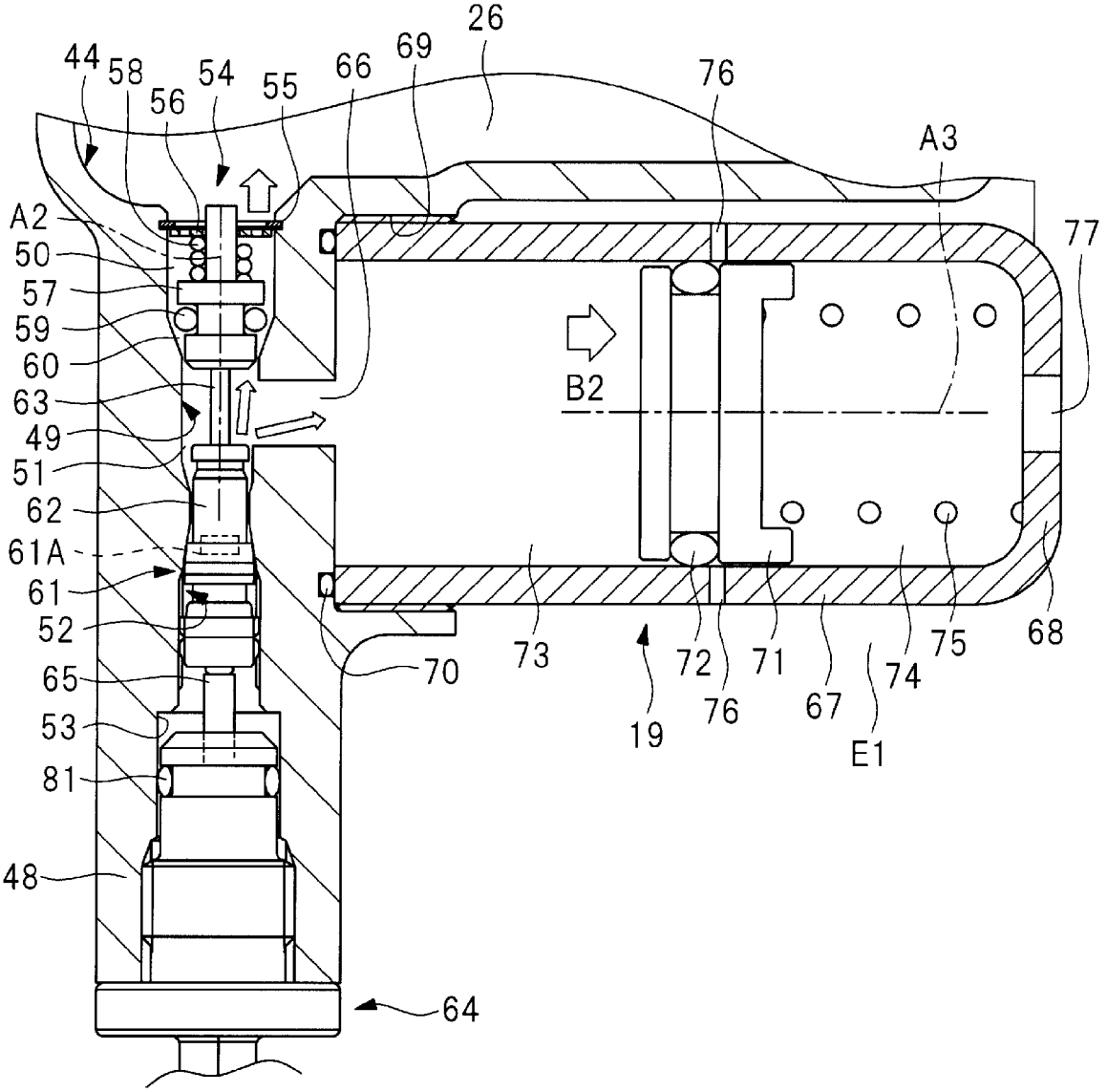
FIG. 7 is a cross-sectional view showing an example in which the main tank and the sub tank are filled with compressed air.

As shown in FIG. 7, a mount 48 protruding from the holder 44 is provided, and the mount 48 forms a holding hole 49. A center line A2 of the holding hole 49 is parallel to the center line A1 of the cylinder. The holding hole 49 is connected to the pressure accumulator 26. The holding hole 49 has a first valve accommodation part 50, a passage 51, a second valve accommodation part 52, and a mounting hole 53. The first valve accommodation part 50 is connected to the pressure accumulator 26. The first valve accommodation part 50 is disposed between the passage 51 and the pressure accumulator 26 in the direction of the center line A2. The passage 51 is disposed between the first valve accommodation part 50 and the second valve accommodation part 52 in the direction of the center line A2.

A one-way valve 54 is provided in the first valve accommodation part 50. The one-way valve 54 has a snap ring 55, a support plate 56, a plunger 57, an urging member 58, and a seal member 59. Further, a second passage 60 is formed between the first valve accommodation part 50 and the passage 51. The snap ring 55 is fixed to the holder 44. The support plate 56 has a hole that penetrates in a thickness direction. The plunger 57 may be operated in the direction of the center line A2. The urging member 58 urges the plunger 57 in the direction of the center line A2. The seal member 59 is attached to the plunger 57. The urging member 58 urges the plunger 57, and the seal member 59 comes into contact with the inner peripheral surface of the holding hole 49. The urging member 58 is, for example, a metal spring. In the one-way valve 54, the seal member 59 comes into contact with the inner peripheral surface of the holding hole 49 to close the second passage 60. When the second passage 60 is closed, connection between the pressure accumulator 26 and the passage 51 is closed. In the one-way valve 54, when the seal member 59 separates from the inner peripheral surface of the holding hole 49, the second passage 60 opens. When the second passage 60 opens, the pressure accumulator 26 and the passage 51 are connected.

When a first urging force, which is the total of the urging force corresponding to the pressure of the pressure accumulator 26 and the urging force applied to the plunger 57 from the urging member 58, and a second urging force applied to the plunger 57 according to the pressure of an auxiliary pressure accumulator 73 are the same, the one-way valve 54 closes the second passage 60. The one-way valve 54 opens the second passage 60 when the second urging force exceeds the first urging force. Therefore, some of the compressed air of the auxiliary pressure accumulator 73 flows into the pressure accumulator 26 via the second passage 60 and the passage 51. When the pressure of the pressure accumulator 26 increases, the one-way valve 54 closes the second passage 60. In this way, the one-way valve 54 allows the compressed air to flow into the pressure accumulator 26 from the passage 51, and prevents the compressed air from returning from the pressure accumulator 26 to the passage 51, that is, flowing out.

An auxiliary valve 61 is provided in the second valve accommodation part 52. The auxiliary valve 61 has a valve core 62, a valve core shaft 63, and a second passage 61A. The valve core shaft 63 has a tubular shape, and the valve core 62 is fixed to the mount 48. The valve core shaft 63 is movable with respect to the valve core 62 in the direction of the center line A2. When the valve core shaft 63 moves and stops in the direction of the center line A2, the second passage 61A is opened and closed. When the second passage 61A opens, the passage 51 and the mounting hole 53 are connected to each other. That is, the compressed air may pass through the second passage 61A. When the second passage 61A is closed, connection between the passage 51 and the mounting hole 53 is closed.

The adapter 64 is inserted into the mounting hole 53 and fixed to the mount 48. The adapter 64 has a pin 65, and the pin 65 is movable with respect to the adapter 64 in the direction of the center line A2. A seal member 81 is attached to an outer peripheral surface of the adapter 64. The seal member 81 has an annular shape, and is made of a synthetic rubber. The seal member 81 hermetically seals between the inner surface of the mounting hole 53 and the adapter 64. A hose of the external device is attached to and detached from the adapter 64. The external device includes a compressor, a cylinder, a tank, and the like.

A passage 66 is provided in the mount 48, and the passage 66 is connected to the passage 51. Further, the sub tank 19 is attached to the mount 48. The sub tank 19 is provided inside the housing 11, and the sub tank 19 is made of a metal as an example. The sub tank 19 has a tubular part 67 and a wall part 68 connected to an end part of the tubular part 67 in a direction of a center line A3. The center line A3 intersects the center line A2. FIG. 7 shows an example in which the center line A2 and the center line A3 intersect each other at an angle of 90 degrees.

A mounting hole 69 is provided in the mount 48, and an end part of the tubular part 67 is fixed to the mounting hole 69. A seal member 70 is provided between the tubular part 67 and the mount 48. The seal member 70 is made of a synthetic rubber.

A piston 71 is disposed in the tubular part 67. The piston 71 is movable in the direction of the center line A3. A seal member 72 is provided on an outer peripheral surface of the piston 71. The seal member 72 has an annular shape, and is made of a synthetic rubber. The piston 71 separates the interior of the sub tank 19 into an auxiliary pressure accumulator 73 and a space 74. The auxiliary pressure accumulator 73 is connected to the passage 66.

Figure 9:
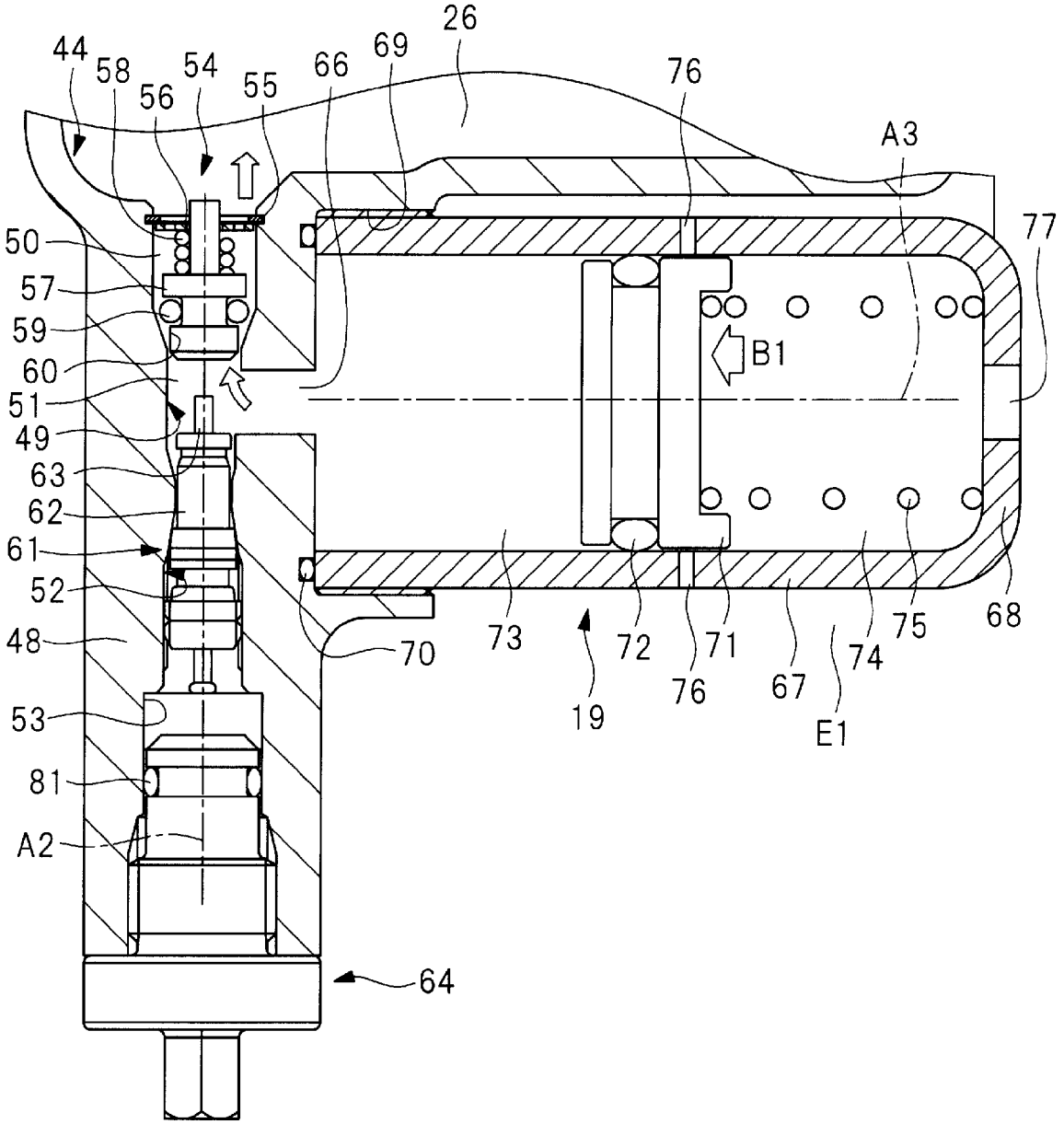
FIG. 9 is a cross-sectional view showing an example in which the compressed air of the sub tank flows into the main tank.

An urging member 75 is disposed in the space 74. The urging member 75 urges the piston 71 shown in FIG. 9 in a third direction B1 toward the one-way valve 54 along the center line A3. That is, the urging member 75 urges the piston 71 in the direction of the center line A3 in which the volume of the auxiliary pressure accumulator 73 is reduced.

The urging member 75 is an elastic body, and as an example, a mechanical spring made of a metal may be used. Furthermore, a constant load spring may be used as the urging member 75. The constant load spring applies a constant urging force to the piston 71, regardless of the position with respect to the sub tank 19 in the direction of the center line A3.

An exhaust hole 76 that penetrates the tubular part 67 in a radial direction is provided. Further, an air hole 77 that penetrates the wall part 68 in the direction of the center line A3 is provided. The exhaust hole 76 connects the inside of the sub tank 19 and the outside E1 of the sub tank 19. The air hole 77 connects the space 74 and the outside E1 of the sub tank 19.

An example in which an operator fills the pressure accumulator 26 with the compressed air will be described. An operation of filling the pressure accumulator 26 with the compressed air is performed with the striking part 12 stopped at the bottom dead center. Examples of reasons for this are as follows. A first reason is that, since the pressure of the compressed air of the pressure accumulator 26 is lowest in a state in which the striking part 12 is stopped at the bottom dead center, the pressure accumulator 26 is easily filled with the compressed air from the outside of the main tank 18. A second reason is that the striking part 12 may be suppressed from operating in the first direction contrary to the operator's intention while the compressed air is being filled. Further, the operator detaches the head cover 22 from the cylinder case 20.

With the hose of the external device connected to the adapter 64, the pin 65 separates from the valve core shaft 63, and the valve core shaft 63 separates from the plunger 57. The auxiliary valve 61 blocks connection between the passage 51 and the mounting hole 53. The one-way valve 54 closes the second passage 60. The seal member 72 is located between the exhaust hole 76 and the passage 66 in the direction of the center line A3.

The operator inserts the hose of the external device into the cylinder case 20, and connects the hose to the adapter 64. Then, the pin 65 pushes the valve core shaft 63, and the passage 51 and the mounting hole 53 are connected to each other. Further, the valve core shaft 63 pushes the plunger 57, and the one-way valve 54 opens the second passage 60, as shown in FIG. 7. The compressed air to be supplied from the external device via the hose is supplied to the passage 51 via the mounting hole 53 and the auxiliary valve 61. A part of the compressed air supplied to the passage 51 flows into the auxiliary pressure accumulator 73 through the passage 66. When the pressure of the auxiliary pressure accumulator 73 increases, the piston 71 operates toward the wall part 68 against the urging force of the urging member 75. That is, the piston 71 operates in a fourth direction B2 away from the one-way valve 54 along the center line A3. Therefore, the urging member 75 accumulates elastic energy.

Further, some of the compressed air supplied to the passage 51 flows into the pressure accumulator 26 through the first valve accommodation part 50. Therefore, the pressure of the pressure accumulator 26 increases. Further, the pressure of the pressure accumulator 26 is the same as the pressure of the auxiliary pressure accumulator 73.

When the pressure of the pressure accumulator 26 and the pressure of the auxiliary pressure accumulator 73 reach a target pressure, the operator detaches the hose from the adapter 64. Then, the pin 65 separates from the valve core shaft 63, and the auxiliary valve 61 blocks connection between the passage 51 and the mounting hole 53. Further, the valve core shaft 63 separates from the plunger 57. Then, the one-way valve 54 closes the second passage 60.

Figure 8:
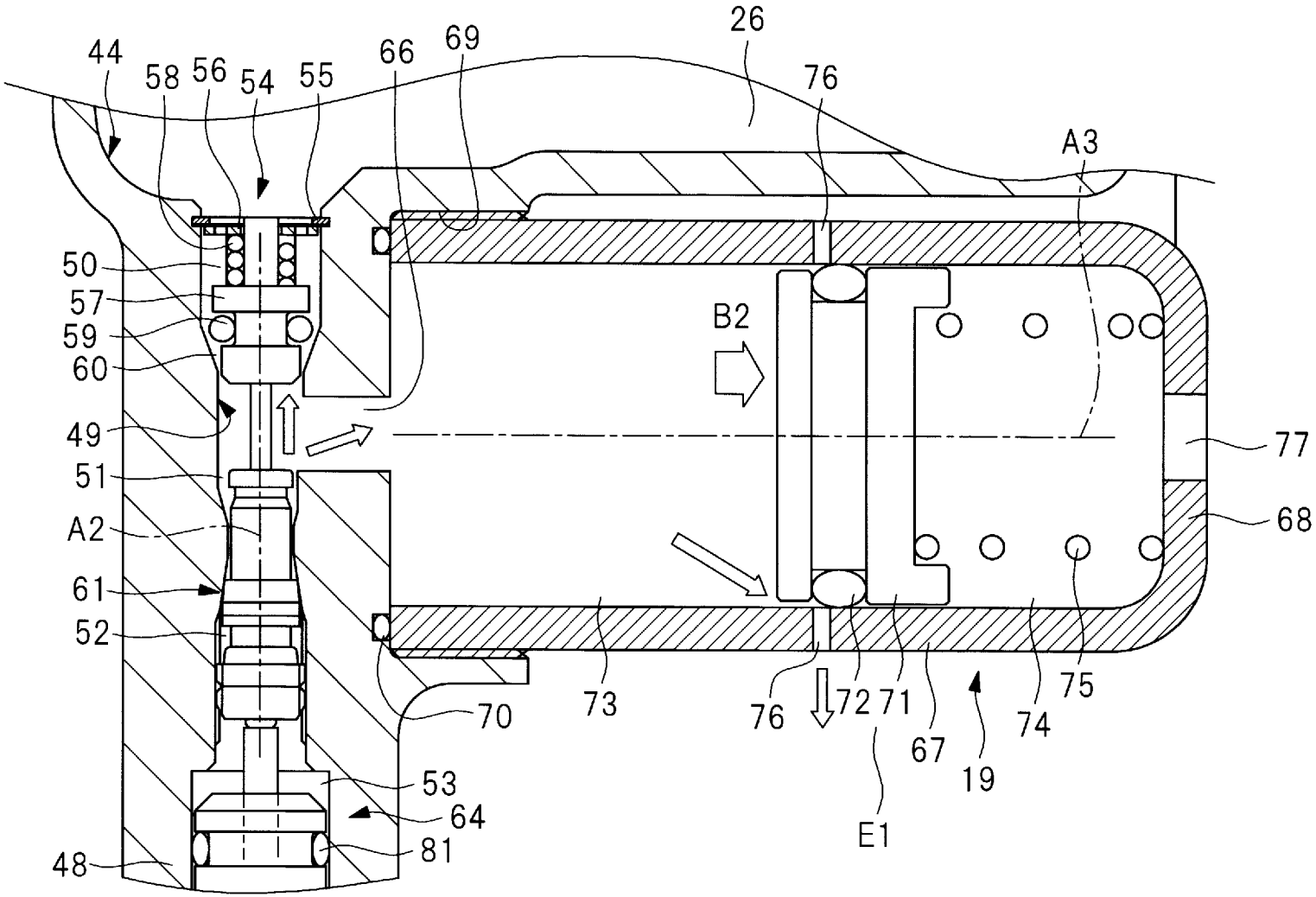
FIG. 8 is a cross-sectional view showing an example in which the compressed air of the sub tank is discharged to the outside.

When the pressure of the pressure accumulator 26 and the pressure of the auxiliary pressure accumulator 73 exceed a target pressure, the seal member 72 moves between the exhaust hole 76 and the wall part 68 in the direction of the center line A3 as shown in FIG. 8. Further, some of the compressed air of the auxiliary pressure accumulator 73 is discharged from the exhaust hole 76 to the outside E1. Therefore, it is possible to prevent the pressure of the pressure accumulator 26 and the pressure of the auxiliary pressure accumulator 73 from exceeding the target pressure.

When some of the compressed air of the auxiliary pressure accumulator 73 is discharged from the exhaust hole 76 to the outside E1, a sound is generated. The operator can recognize that the pressure of the pressure accumulator 26 and the pressure of the auxiliary pressure accumulator 73 exceed the target pressure. When an opening area of the exhaust hole 76 is appropriately set, a leakage sound of air is generated during exhaust. Further, a member such as a whistle may be added to the exhaust hole 76. Furthermore, a penetration hole in a direction intersecting the discharge direction of the exhaust hole 76 may also be provided in the tubular part 67. In this way, during exhaust, a loud sound is produced by the principle of a whistle.

The target pressure is a pressure defined from a value exceeding the power when the striking part 12 strikes the nail 41. The target pressure is defined, for example, depending on a stroke amount when the striking part 12 moves from the bottom dead center to a standby position.

Next, an example in which the operator uses the driving tool 10 will be described. The control part 42 stops the electric motor 15 when it is not possible to detect at least one of application of the manipulation force to the trigger 80 or pressing of the push lever 32 against the driving target material W1. When the electric motor 15 is stopped, the striking part 12 is stopped at the standby position. In the present embodiment, as an example, it is assumed that the striking part 12 is stopped at the standby position at which the piston 27 is between the bottom dead center and the top dead center. The top dead center of the piston 27 is a position farthest from the bumper 30 in the direction of the center line A1. The bottom dead center of the piston 27 is a position in contact with the bumper 30 in the direction of the center line A1.

Further, the pinion pin 37 and the protrusion 38 are engaged with each other, and the urging force received by the striking part 12 from the pressure accumulator 26 is transferred to the pin wheel 36. The turning restricting mechanism 39 stops the pin wheel shaft 35, and the striking part 12 stops at the standby position.

When the control part 42 detects that the manipulation force is applied to the trigger 80 and that the push lever 32 is pressed against the driving target material W1, the electric motor 15 turns forward. The turning force of the electric motor 15 is transferred to the pin wheel 36 via the reduction mechanism 16.

The turning force of the pin wheel 36 is transferred to the striking part 12, and the striking part 12 ascends. When the striking part 12 ascends, the volume of the pressure accumulator 26 is narrowed, and the pressure of the pressure accumulator 26 increases. The pressure of the pressure accumulator 26 exceeds the pressure of the auxiliary pressure accumulator 73. When the piston 27 reaches the top dead center, all the pinion pins 37 are disengaged from all the protrusions 38. Then, the striking part 12 descends under the pressure of the pressure accumulator 26. When the striking part 12 descends, the driver blade 28 strikes the nail 41 in the ejection part 13, and the nail 41 is driven into the driving target material W1. The push lever 32 separates from the driving target material W1 under the reaction force with which the driver blade 28 strikes the nail 41. Further, the piston 27 collides with the bumper 30.

The control part 42 processes the signal from the position detection sensor to detect whether the striking part 12 has reached the standby position. The control part 42 stops the electric motor 15 when the striking part 12 reaches the standby position.

On the other hand, the pressure of the pressure accumulator 26 and the pressure of the auxiliary pressure accumulator 73 are the same at the time point when the pressure accumulator 26 and the auxiliary pressure accumulator 73 are filled with compressed air. There is a likelihood that the compressed air of the pressure accumulator 26 may leak to the outside of the main tank 18 when a certain period elapses from the time point when the pressure accumulator 26 and the auxiliary pressure accumulator 73 are filled with the compressed air. As an example, the compressed air leaks from a place sealed by any of the seal members 29, 46, and 47. Then, the pressure of the pressure accumulator 26 becomes lower than the pressure of the auxiliary pressure accumulator 73.

Such leakage of compressed air is caused by the fact that, since the pressure of the pressure accumulator 26 repeatedly increases and drops each time the striking part 12 performs a hitting operation, a repetitive pressure change occurs in the seal members 29, 46, and 47. In particular, since the seal member 29 slides on the inner peripheral surface of the cylinder 25 in accordance with the operation of the striking part 12, combined with the pressure change in the pressure accumulator 26, the compressed air is more likely to leak.

The one-way valve 54 closes the second passage 60 when the first urging force applied to the plunger 57 is the same as the second urging force applied to the plunger 57. In the one-way valve 54, when the second urging force exceeds the first urging force, the plunger 57 operates under the pressure of the passage 51 to automatically open the second passage 60. Therefore, some of the compressed air of the auxiliary pressure accumulator 73 flows into the pressure accumulator 26 via the second passage 60 and the passage 51. When the pressure of the pressure accumulator 26 increases and becomes equal to or higher than the predetermined pressure, the one-way valve 54 automatically closes the second passage 60.

The predetermined pressure mentioned here is a target pressure for the bottom dead center that should be ensured in a state in which the striking part 12 is at the bottom dead center, and the target pressure for the bottom dead center defines a hitting force to be provided when the striking part 12 is at the top dead center, that is, a required pressure at the top dead center required for the striking part 12 to operate to drive the nail 41 into the driving target material W1 by a required amount. The target pressure of the pressure accumulator 26 in a state in which the striking part 12 is located at the bottom dead center is defined according to the target energy of the hitting energy which is applied to the nail 41 when the striking part 12 operates from the top dead center.

In this way, when the pressure of the pressure accumulator 26 drops below the predetermined pressure, the one-way valve 54 automatically opens the second passage 60 to supply some of the compressed air of the auxiliary pressure accumulator 73 to the pressure accumulator 26. Therefore, it is possible to suppress a decrease in power when the striking part 12 operates in the first direction, that is, a decrease in hitting force of the striking part 12.

When some of the compressed air of the auxiliary pressure accumulator 73 flows into the pressure accumulator 26, the piston 71 moves away from the wall part 68 under the urging force of the urging member 75. When the one-way valve 54 blocks connection between the pressure accumulator 26 and the passage 51, the piston 71 stops. In this way, as some of the compressed air of the auxiliary pressure accumulator 73 flows into the pressure accumulator 26, the piston 71 operates away from the wall part 68, and the volume of the auxiliary pressure accumulator 73 decreases. The urging member 75 urges the piston 71 in a direction in which the volume of the auxiliary pressure accumulator 73 is reduced and dominates the pressure of the auxiliary pressure accumulator 73. Specifically, the pressure is maintained substantially the same as at the time point when the auxiliary pressure accumulator 73 is filled with the compressed air.

Further, the center line A3 is disposed to intersect the center line A1 at 90 degrees. Therefore, since the striking part 12 strikes the nail 41 or the piston 27 collides with the bumper 30, it is possible to reduce and suppress the movement of the piston 71 in the direction of the center line A3 when the housing 11 vibrates in the direction of the center line A2.

In addition to the aforementioned effects, the auxiliary pressure accumulator 73 has less pressure change that causes compressed air leakage and fewer seal members than the pressure accumulator 26. Therefore, the pressure drop in the auxiliary pressure accumulator 73 itself is suppressed to an infinitesimally small amount, and even when the driving tool 10 is used for a long period of time, the function of compensating for the pressure drop of the pressure accumulator 26 can be sufficiently maintained.

Another example of a mechanism for supplying the compressed air to the pressure accumulator 26 will be described with reference to FIG. 10. The sub tank 19 is disposed around the center line A2. Both the piston 71 and the plunger 57 are operable in the direction of the center line A2. The piston 71 is operable in a third direction B1 approaching the one-way valve 54 along the center line A2, and the piston 71 is operable in a fourth direction B2 away from the one-way valve 54 along the center line A2. The holding hole 49, the auxiliary valve 61, and the adapter 64 are disposed around the center line A3. The auxiliary valve 61 is operable in the direction of the center line A3.

The auxiliary pressure accumulator 73 is connected to the passage 51. The passage 66 shown in FIG. 7 is not provided in the example shown in FIG. 10. Other configurations of FIG. 10 are the same as the other configurations of FIG. 7.

With the hose attached to the adapter 64, the pin 65 separates from the plunger 57. Next, the operator supplies the compressed air to the passage 51 via the adapter 64 and the auxiliary valve 61. Then, a part of the compressed air supplied to the passage 51 flows into the auxiliary pressure accumulator 73. When the second urging force exceeds the first urging force, the one-way valve 54 opens the second passage 60, and part of the compressed air supplied to the passage 51 flows into the pressure accumulator 26. When the operator detaches the hose from the adapter 64, the auxiliary valve 61 blocks the passage 51 and the mounting hole 53. The one-way valve 54 also closes the second passage 60.

Figure 10:
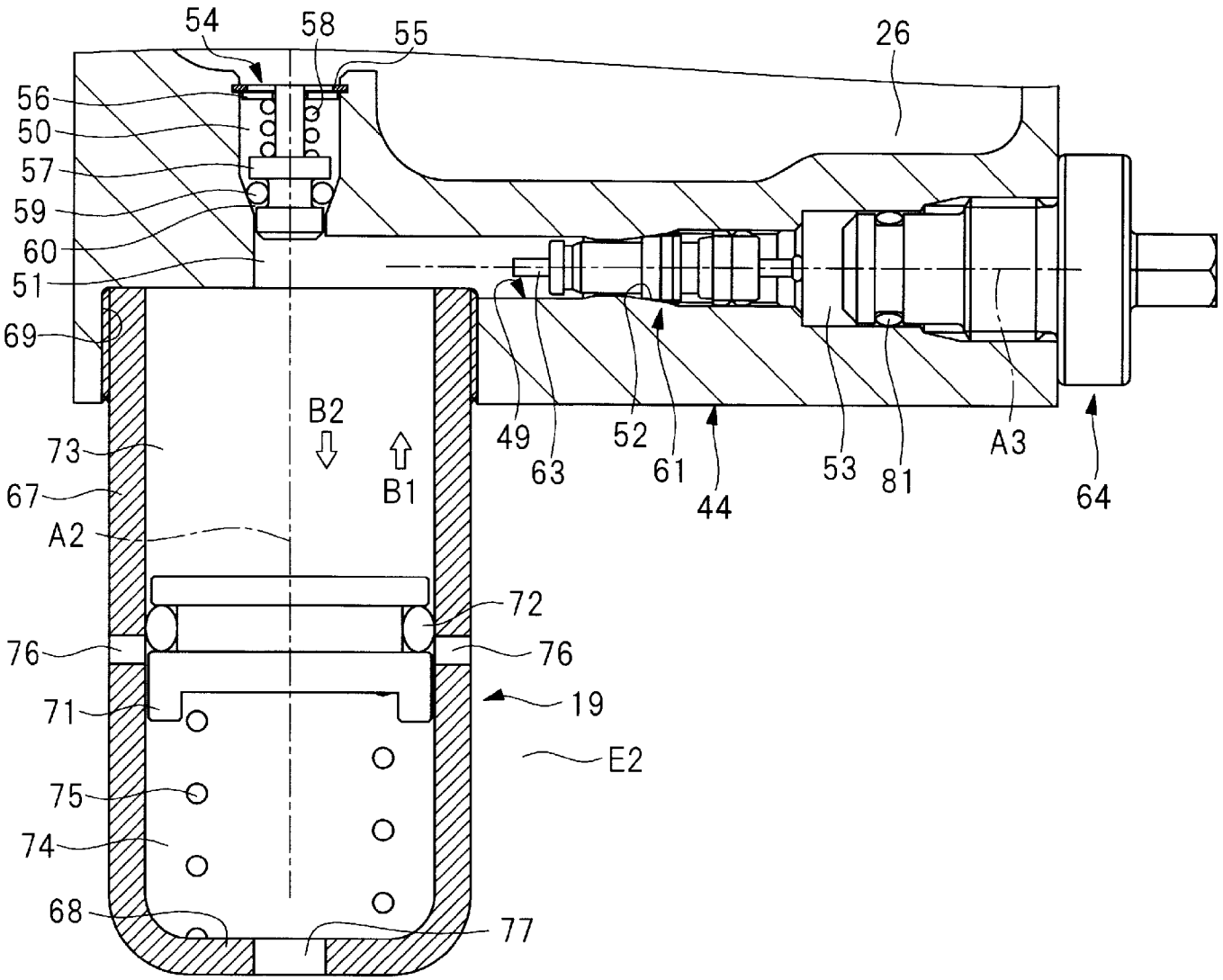
FIG. 10 is a cross-sectional view showing another example of the sub tank and the compressed air filling mechanism.

Also in the element shown in FIG. 10, when the pressure of the pressure accumulator 26 decreases, the compressed air of the auxiliary pressure accumulator 73 flows into the pressure accumulator 26, and the pressure of the pressure accumulator 26 can be increased. Other operational effects of the element shown in FIG. 10 are the same as the operational effects of the element shown in FIG. 7.

Figure 11:
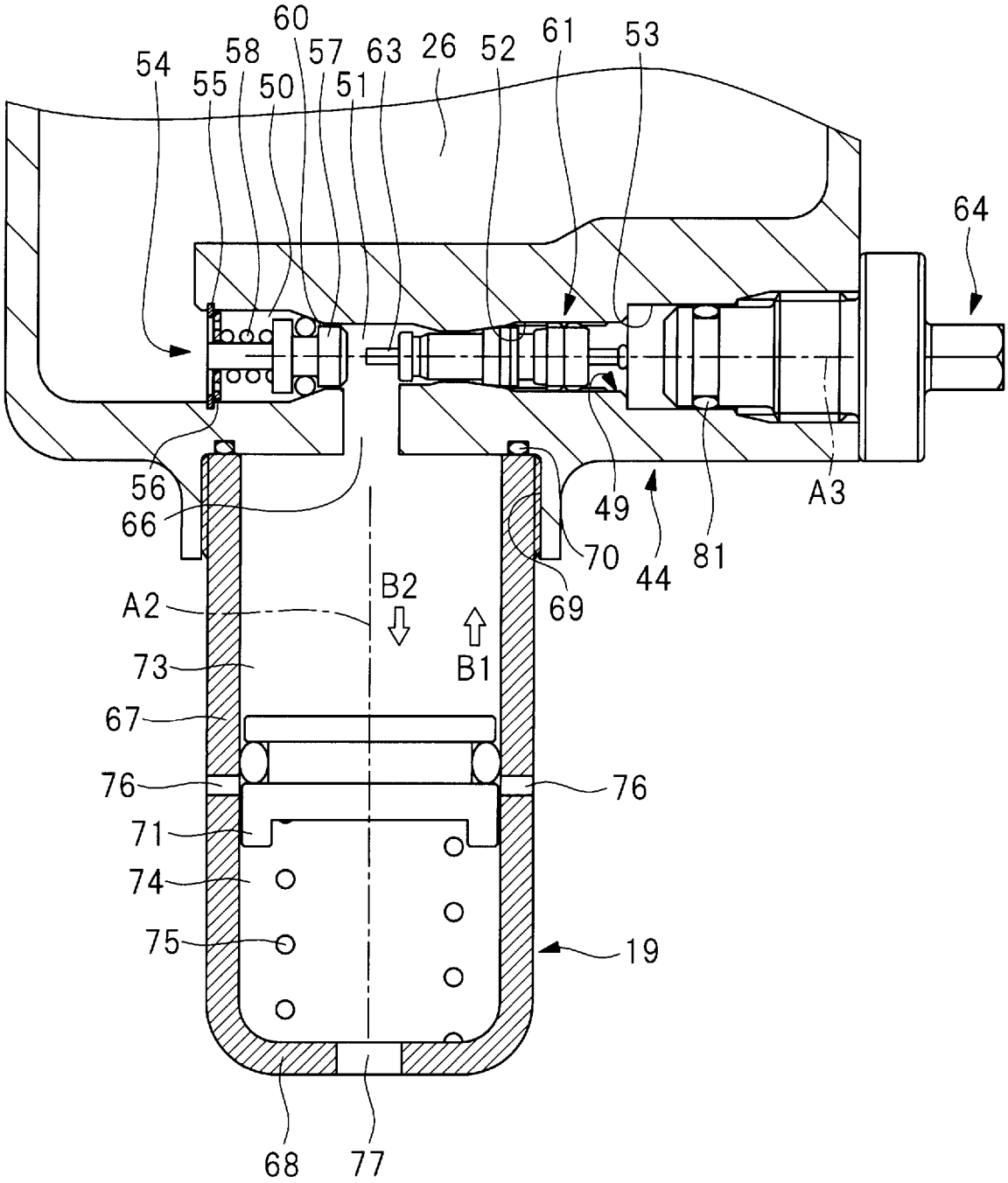
FIG. 11 is a cross-sectional view showing still another example of the sub tank and the compressed air filling mechanism.

Another example of a mechanism for supplying the compressed air to the pressure accumulator 26 will be described with reference to FIG. 11. The sub tank 19 is disposed around the center line A2. The piston 71 is operable in the direction of the center line A2. The one-way valve 54, the holding hole 49, the auxiliary valve 61, and the adapter 64 are disposed around the center line A3. The plunger 57 and the auxiliary valve 61 is operable in the direction of the center line A3. The auxiliary pressure accumulator 73 is connected to the passage 51 via the passage 66. Other configurations of FIG. 11 are the same as other configurations of FIGS. 7 and 10.

When the operator attaches the hose to the adapter 64, the pin 65 pushes the plunger 57, and the one-way valve 54 opens the second passage 60. The auxiliary valve 61 and the adapter 64 shown in FIG. 11 may fill the pressure accumulator 26 and the auxiliary pressure accumulator 73 with the compressed air. When the operator detaches the hose from the adapter 64, the pin 65 separates from the plunger 57 and the one-way valve 54 closes the second passage 60. Further, the auxiliary valve 61 blocks the passage 51 and the mounting hole 53.

Then, when the pressure of the pressure accumulator 26 decreases, the compressed air of the auxiliary pressure accumulator 73 flows into the pressure accumulator 26, and the pressure of the pressure accumulator 26 can be increased. Other operational effects of the elements shown in FIG. 11 are the same as the operational effects of the elements shown in FIG. 7.

Still another example of the mechanism for supplying the compressed air to the pressure accumulator 26 will be described with reference to FIG. 12. In the configuration shown in FIG. 12, the same components as those shown in FIG. 10 are designated by the same reference numerals as those of FIG. 10. Comparing the example of FIG. 10 with the example of FIG. 12, the piston 71, the seal member 72, the urging member 75, the exhaust hole 76, the space 74, and the air hole 77 shown in FIG. 10 are not provided in the example of FIG. 12.

Figure 12:
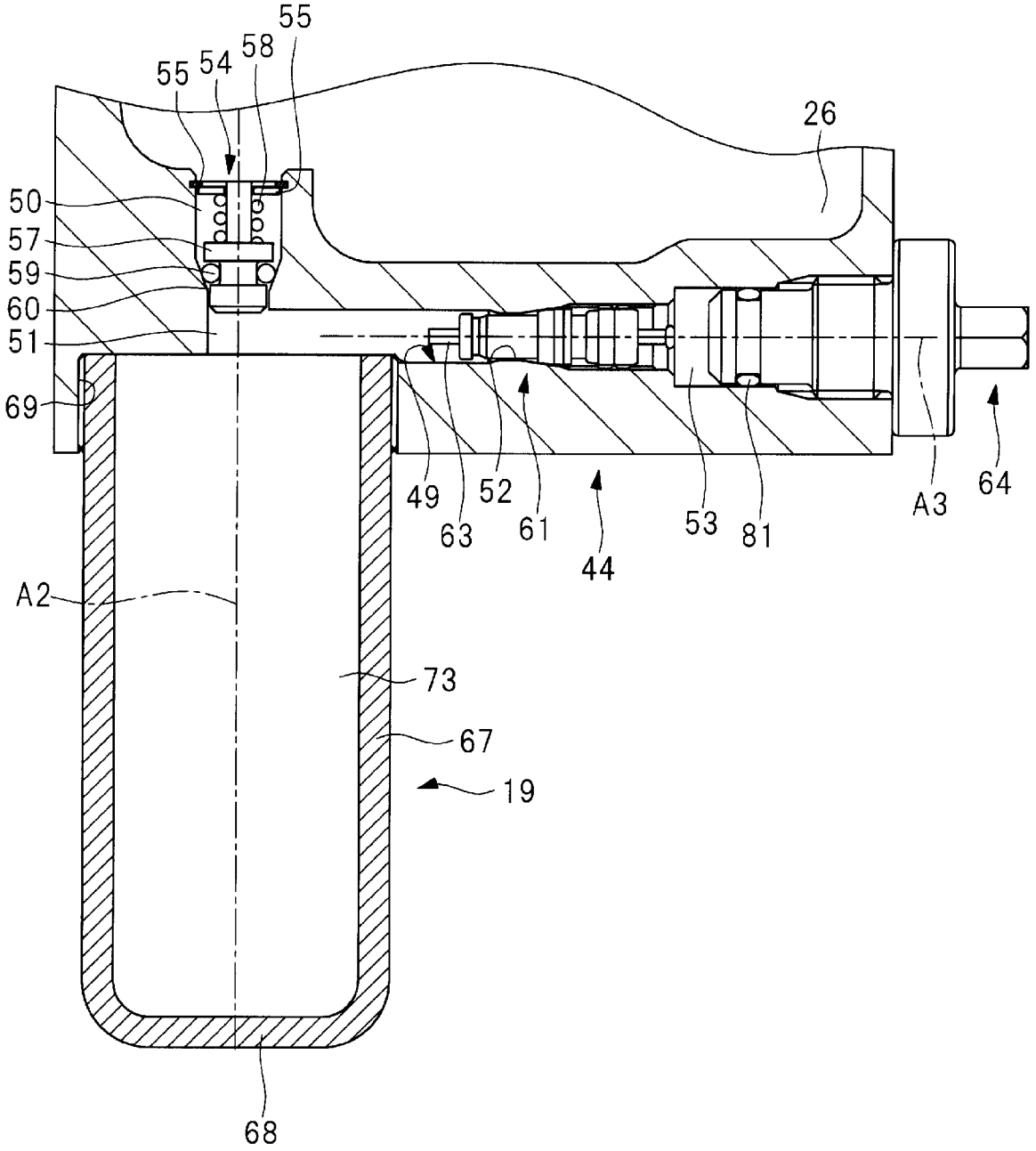
FIG. 12 is a cross-sectional view showing still another example of the sub tank and the compressed air filling mechanism.

Therefore, in the example of FIG. 12, when the pressure of the pressure accumulator 26 decreases after a period elapses from the time point when the pressure accumulator 26 and the auxiliary pressure accumulator 73 are filled with the compressed air, the compressed air of the auxiliary pressure accumulator 73 is supplied to the pressure accumulator 26. However, since the space 74 and the urging member 75 do not exist, the pressure of the pressure accumulator 26 does not increase to the initial pressure, the compressed air is supplied to the pressure accumulator 26 so that the pressure accumulator 26 and the auxiliary pressure accumulator 73 have uniform pressures. Therefore, in the example of FIG. 12, the pressure of the pressure accumulator 26 does not increase to the initial pressure, but the pressure change is less than that of the pressure accumulator 26, and the number of seal members that cause leakage of compressed air is extremely small. Thus, the amount of pressure drop of the pressure accumulator 26 can be reduced.

Figure 13:
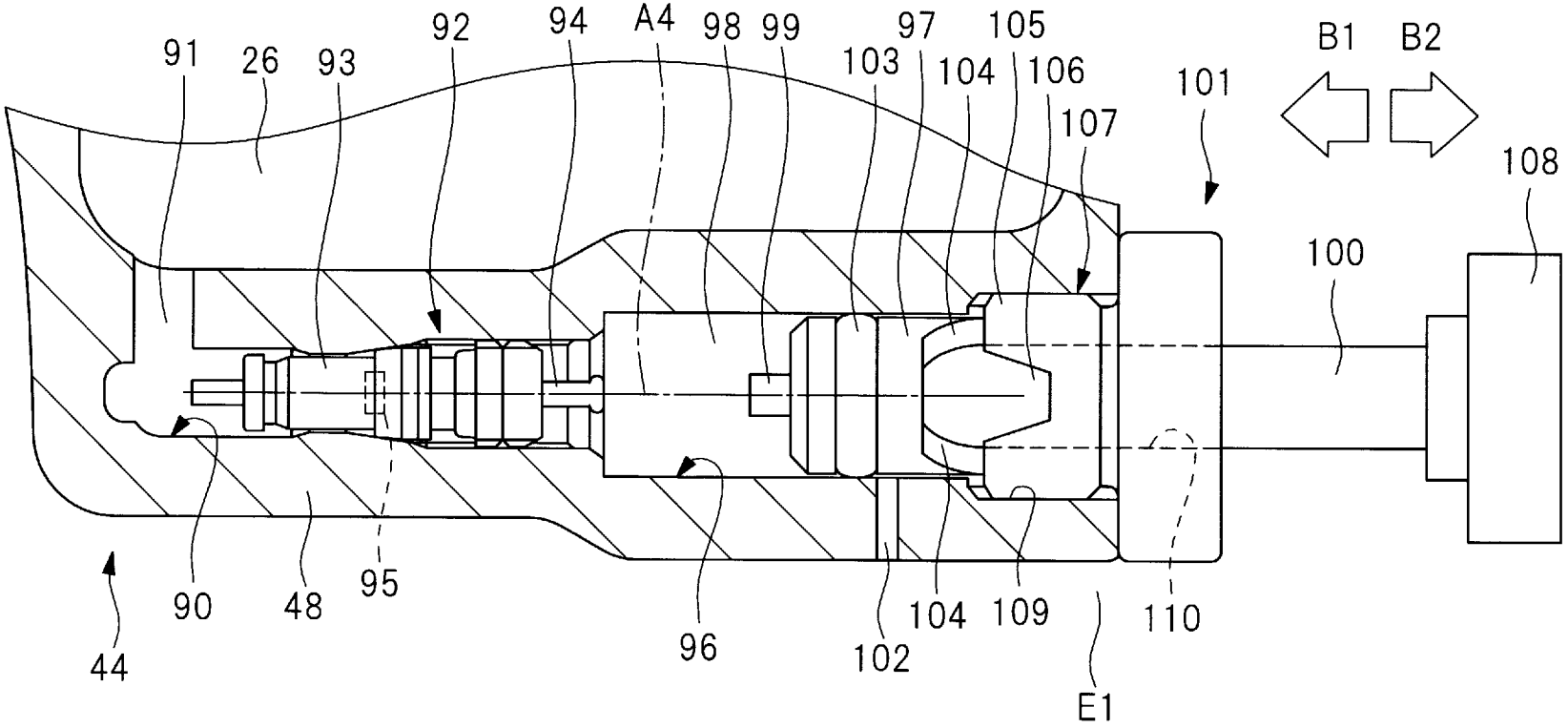
FIG. 13 is another example of the compressed air filling mechanism, and is a cross-sectional view of a state in which a piston is at an initial position.

Still another example of the mechanism for supplying the compressed air to the pressure accumulator 26 will be described with reference to FIGS. 13, 14 and 15. As shown in FIG. 13, the holder 44 has a mount 48, and a holding hole 90 is formed by the mount 48. A center line A4 of the holding hole 90 intersects the center line A1 of the cylinder. The holding hole 90 is connected to the pressure accumulator 26 via a passage 91. A switching valve 92 is provided in the holding hole 90. The switching valve 92 has a valve core 93, a valve core shaft 94, a passage 95, and an urging member that urges the valve core shaft 94. The valve core 93 has a tubular shape, and the valve core 93 is fixed to the mount 48. The valve core shaft 94 is movable with respect to the valve core 93 in the direction of the center line A4. The urging member that urges the valve core shaft 94 is, for example, a metal spring.

A mounting hole 96 is provided in the mount 48. The mounting hole 96 is connected to the holding hole 90, and an open end part of the mounting hole 96 is exposed on the surface of the mount 48. The holding hole 90 and the mounting hole 96 are disposed concentrically around the center line A4. A piston 97 is disposed in the mounting hole 96. In the mounting hole 96, a cylinder chamber 98 is formed between the piston 97 and the valve core 93. When the valve core shaft 94 operates in the direction of the center line A4, the passage 95 opens and closes. When the passage 95 opens, the cylinder chamber 98 and the passage 91 are connected to each other. When the passage 95 is closed, the cylinder chamber 98 and the passage 91 are block. The mount 48 has a passage 102, and the passage 102 connects the mounting hole 96 and the outside E1.

The seal member 103 is attached to an outer peripheral surface of the piston 97. The seal member 103 comes into contact with an inner surface of the mounting hole 96 to hermetically seal the cylinder chamber 98. The piston 97 has a push pin 99 and a positioning protrusion 104. The positioning protrusions 104 are provided at two locations in the circumferential direction centering on the center line A4. The shaft 100 is connected to the piston 97. The shaft 100 is disposed over the mounting hole 96 and the outside E1 of the holder 44.

The shaft 100 is operable with the piston 97 along the center line A4 in the third direction B1 and the fourth direction B2. The third direction B1 and the fourth direction B2 are opposite to each other. When the piston 97 operates in the third direction B1, the piston 97 approaches the switching valve 92. When the piston 97 operates in the fourth direction B2, the piston 97 separates from the switching valve 92. A knob 108 is fixed to an end part of the shaft 100 located outside the mounting hole 96. The operator may operate the knob 108.

Any of a structure in which the entire shaft 100 is provided inside the housing 11 or a structure, in which the end part of the shaft 100 to which the piston 97 is not attached is exposed to the outside of the housing 11, may be provided. In the structure in which the end part of the shaft 100 is exposed to the outside of the housing 11, an opening part is provided in the housing 11, and a part of the shaft 100 is configured to be operable inside the opening part.

Further, a cap 101 is attached to the mount 48. The cap 101 has a tubular part 107 and a shaft hole 110, and a male screw 105 is provided on an outer peripheral surface of the tubular part 107. A female screw 109 is provided on an inner peripheral surface of the mounting hole 96. When the operator turns the cap 101, the cap 101 may be attached to and detached from the mount 48. The tubular part 107 has a concave part 106. The concave part 106 are provided at two locations in the circumferential direction centering on the center line A4.

The shaft 100 is disposed inside the shaft hole 110. An inner diameter of the shaft hole 110 is smaller than an outer diameter of the piston 97 and smaller than an outer diameter of the knob 108. When the cap 101 is fixed to the mount 48, the piston 97 and the shaft 100 do not come off the mount 48. In a state in which the cap 101 is fixed to the mount 48, the shaft 100 and the piston 97 are operable inside the shaft hole 110 along the center line A4. The shaft 100 is rotatable around the center line A4 with respect to the cap 101. When the cap 101 is detached from the mount 48, the piston 97 and the shaft 100 may come off the mount 48.

When the operator uses the driving tool 10, the shaft 100 is not operated. The positioning protrusion 104 is located outside the concave part 106. A tip of the positioning protrusion 104 comes into contact with the tubular part 107, and the piston 97 is stopped at the initial position in the direction of the center line A4. When the piston 97 is stopped at the initial position, the seal member 103 blocks the cylinder chamber 98 and the passage 102. That is, the seal member 103 seals the cylinder chamber 98. Also, the push pin 99 separates from the valve core shaft 94. Therefore, the passage 95 of the switching valve 92 is closed. Therefore, the passage 91 and the cylinder chamber 98 are blocked. Accordingly, the compressed air of the pressure accumulator 26 does not leak to the pressure chamber.

FIG. 13 shows an example of the initial position of the piston 97. The initial position of the piston 97 may be a position at which the seal member 103 blocks the cylinder chamber 98 and the passage 102, and the push pin 99 separates from the valve core shaft 94, and is not limited to the position of the piston 97 of FIG. 13.

When the operator recognizes power insufficiency of the striking part 12, the operator may perform the next work in the state in which the striking part 12 is stopped at the bottom dead center.

The operator grasps the knob 108 with a finger, turns the shaft 100 around the center line A4 by a predetermined angle, locates the positioning protrusion 104 and the concave part 106 at the same position in the circumferential direction centering on the center line A1, and stops the shaft 100.

Furthermore, the shaft 100 and the piston 97 are operated in a direction along the center line A4 and away from the switching valve 92. Then, the positioning protrusion 104 enters the concave part 106. When the piston 97 operates in the direction away from the switching valve 92, the volume of the cylinder chamber 98 is enlarged. Further, as shown in FIG. 14, the shaft 100 and the piston 97 are stopped at the first operating position at which the piston 97 comes into contact with the cap 101. The seal member 103 connects the cylinder chamber 98 and the passage 102, before the piston 97 stops at the first operating position or at the time point when the piston 97 stops at the first operating position. Therefore, the cylinder chamber 98 is connected to the outside E1 via the passage 102.

Further, the operator operates the shaft 100 and the piston 97 in the third direction B1. Then, as shown in FIG. 13, the seal member 103 blocks the cylinder chamber 98 and the passage 102. Further, when the piston 97 operates in a direction approaching the switching valve 92, the volume of the cylinder chamber 98 is reduced, the air is compressed, and the pressure of the cylinder chamber 98 increases.

Figure 15:
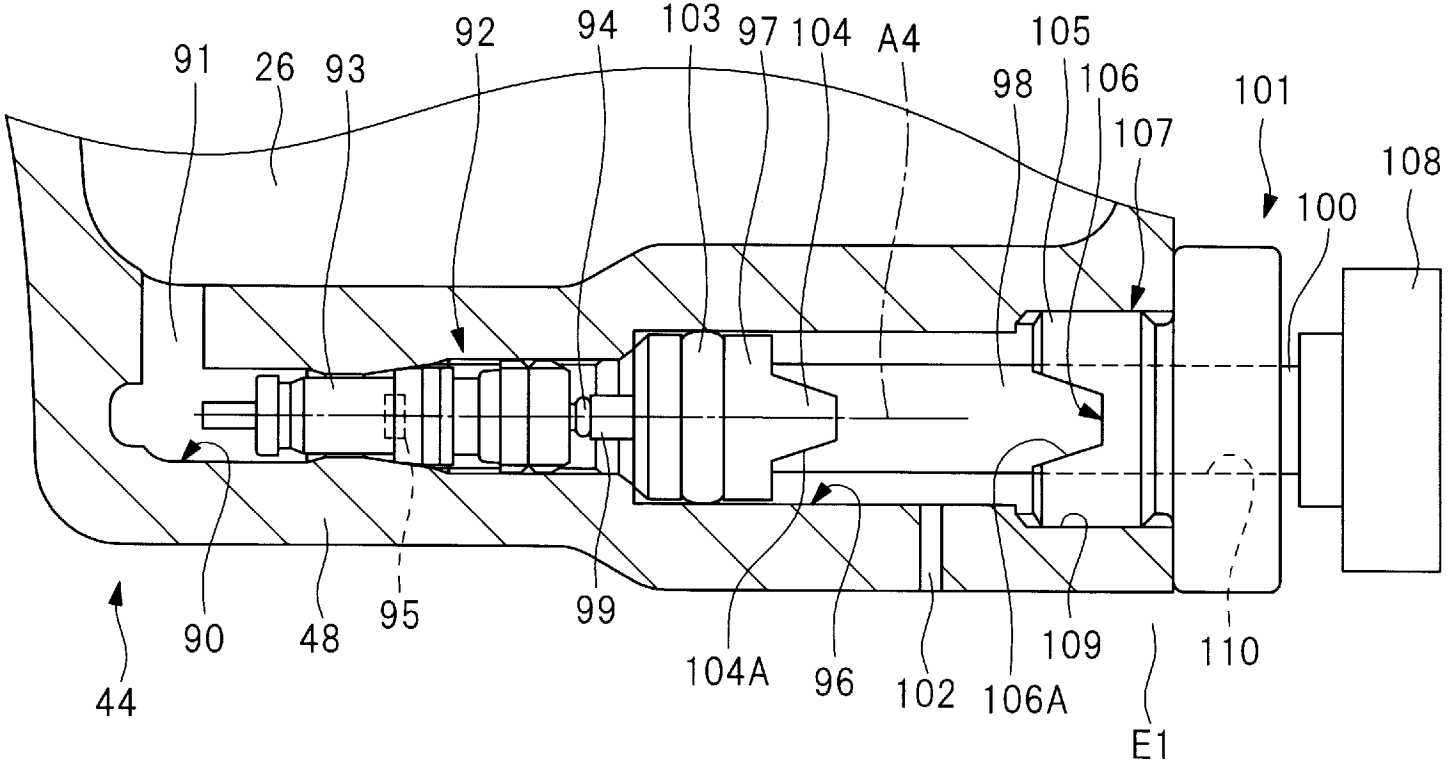
FIG. 15 is a cross-sectional view of a state in which the piston shown in FIG. 13 at a second operating position.

Then, the operator stops the shaft 100 and the piston 97 at the second operating position shown in FIG. 15. Before the piston 97 reaches the second operating position, or at the time point when the piston 97 reaches the second operating position, the push pin 99 is pressed against the valve core shaft 94, and the passage 95 opens. Therefore, the air compressed in the cylinder chamber 98 is supplied to the pressure accumulator 26 via the passage 91. At this time, the pressure of the cylinder chamber 98 compressed by the piston 97 is preferably substantially the same as the target pressure of the pressure accumulator 26. The target pressure of the pressure accumulator 26 is a pressure corresponding to the state in which the piston 97 is stopped at the bottom dead center.

In addition, the operator operates the shaft 100 and the piston 97 stopped at the second operation position in a direction along the center line A4 and away from the switching valve 92. Then, the push pin 99 separates from the valve core shaft 94, the valve core shaft 94 is operated by the force of the urging member, and stops, and the passage 95 is closed. Thereafter, the operator repeats the manipulation of causing the piston 97 to reciprocate between the first operating position and the second operating position, and performs the operation of supplying the air compressed in the cylinder chamber 98 to the pressure accumulator 26 via the passage 91. Further, the operator turns the shaft 100 around the center line A4 to set the positioning protrusion 104 and the concave part 106 at different positions around the center line A4, and then stops the shaft 100 and the piston 97 at the initial position as shown in FIG. 13.

Figure 14:
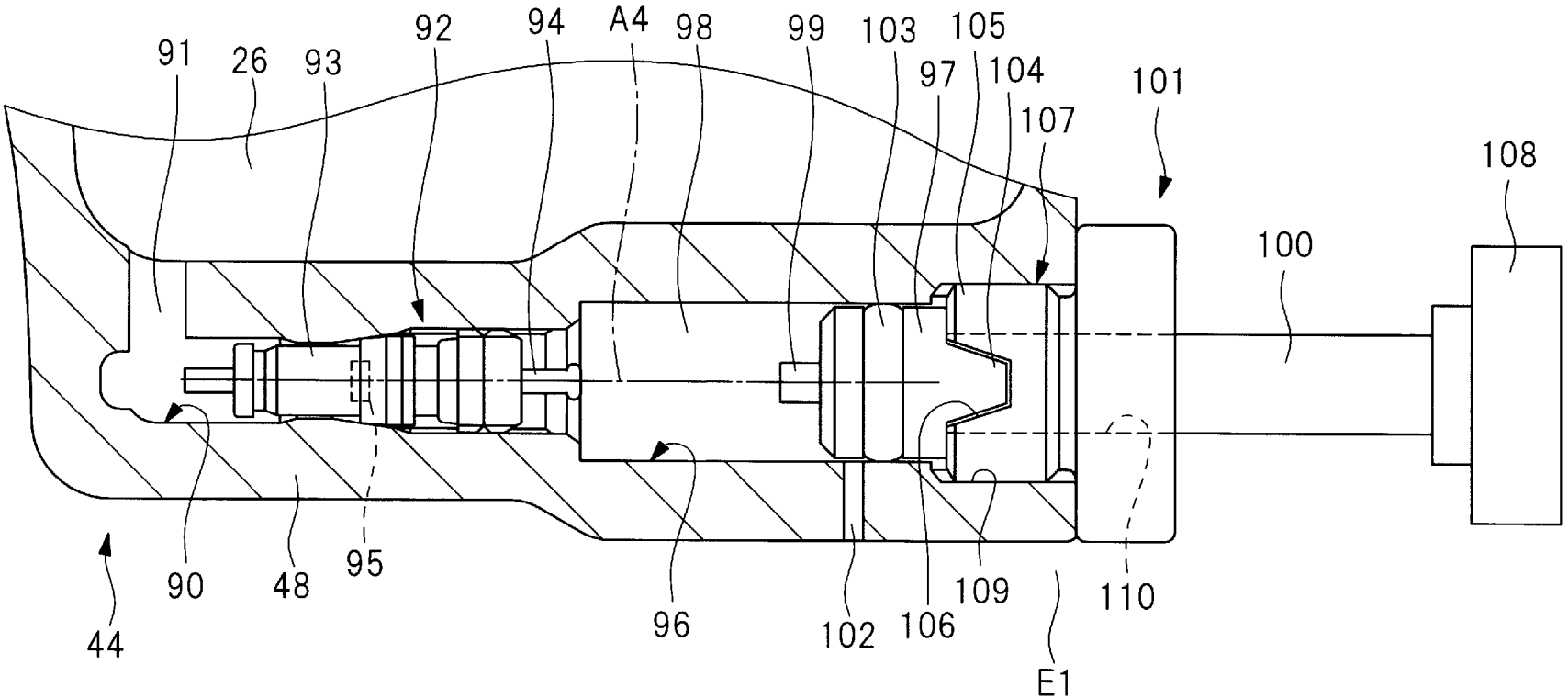
FIG. 14 is a cross-sectional view of a state in which the piston shown in FIG. 13 at a first operating position.

In this way, in the embodiment shown in FIGS. 13, 14 and 15, when the pressure of the pressure accumulator 26 drops, the piston 97 may be operated by the manipulation force of the operator to supply the air of the cylinder chamber 98 to the pressure accumulator 26, and the pressure of the pressure accumulator 26 can be increased. Therefore, it is not necessary to bring the driving tool 10 to a repair shop for maintenance of the driving tool 10, and the usability of the driving tool 10 can be improved.

Further, the maximum pressure of the cylinder chamber 98 is determined on the basis of parameters such as the volume of the cylinder chamber 98 and the effective operation amount of the piston 97. Therefore, it is possible to prevent the pressure accumulator 26 from being filled with air beyond the upper limit pressure of the pressure accumulator 26. The effective operation amount of the piston 97 is an amount with which the piston 97 is operable in a direction of approaching the switching valve 92, in the state in which the seal member 103 blocks the cylinder chamber 98 and the passage 102.

Further, in the state in which the passage 95 of the switching valve 92 is closed, even if the compressed air of the pressure accumulator 26 leaks into the cylinder chamber 98 from the contact location between the valve core 93 and the mount 48, when the piston 97 stops at the initial position, the seal member 103 blocks the cylinder chamber 98 and the passage 102. Therefore, the air of the cylinder chamber 98 can be prevented from leaking to the outside E1.

The operator operates the shaft 100 and the piston 97 to fill the pressure accumulator 26 with air, in the state in which the striking part 12 is stopped. The state in which the striking part 12 is stopped may be either a first state in which the striking part 12 is in contact with the bumper 30 and stopped, or a second state in which the striking part 12 separates from the bumper 30 and stopped. When the striking part 12 is stopped in the first state, the maximum pressure of the pressure accumulator 26 that may increase by the operation of the piston 97 is set to be lower than the maximum pressure of the pressure accumulator 26 that may increase by the operation of the piston 97 when the striking part 12 is stopped in the second state.

Figure 16:
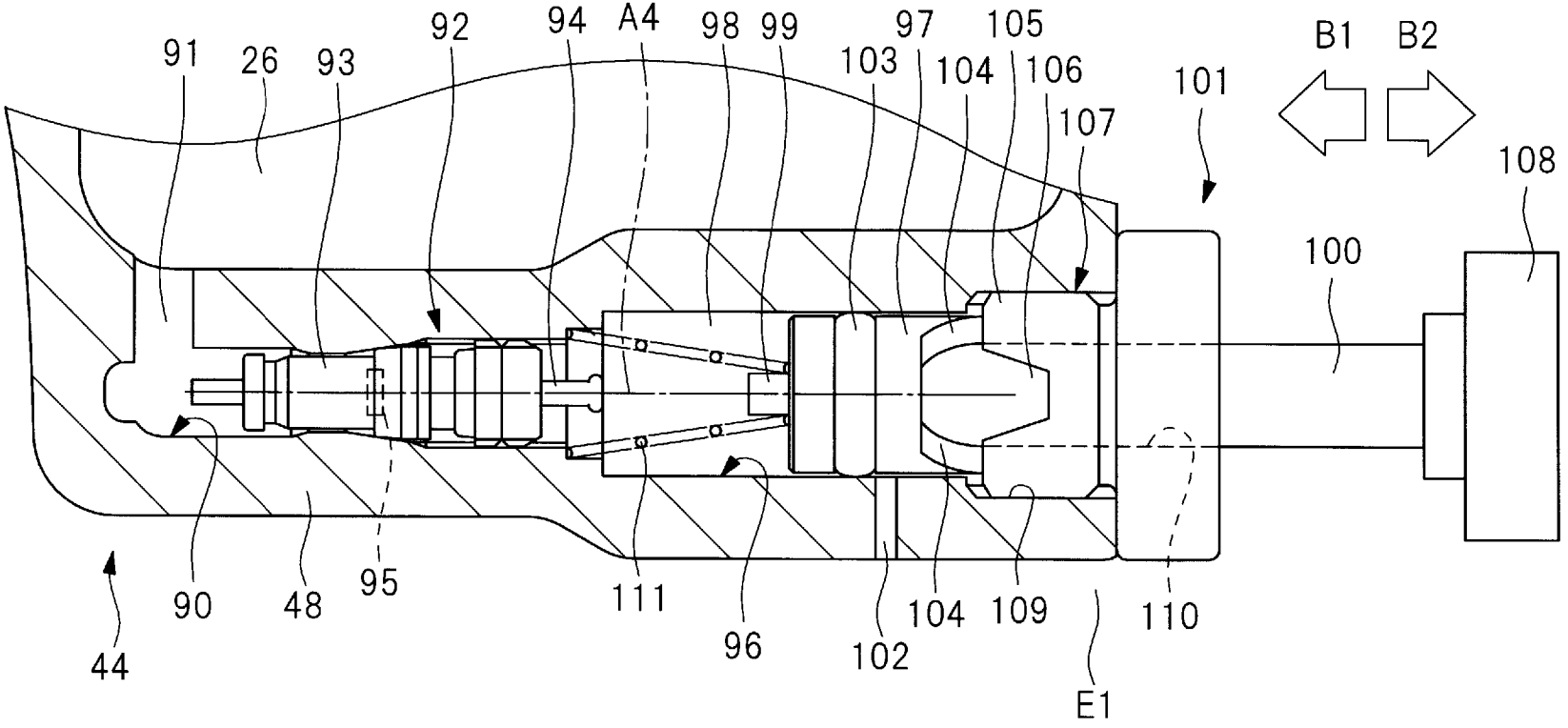
FIG. 16 is a cross-sectional view of a state in which the piston is at the initial position, which is an example in which an urging member is provided in the compressed air filling mechanism of FIG. 13.
Figure 17:
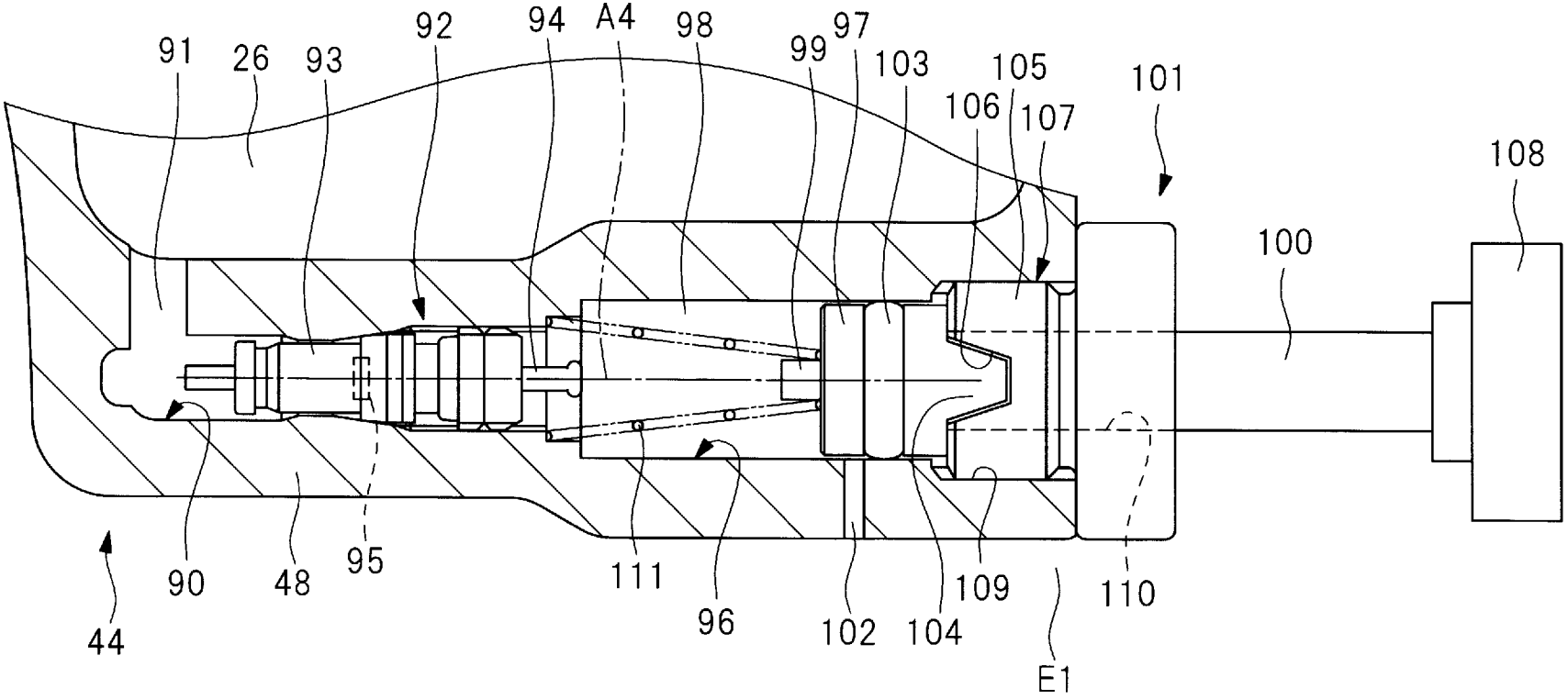
FIG. 17 is a cross-sectional view of a state in which the piston shown in FIG. 16 is at the first operating position.
Figure 18:
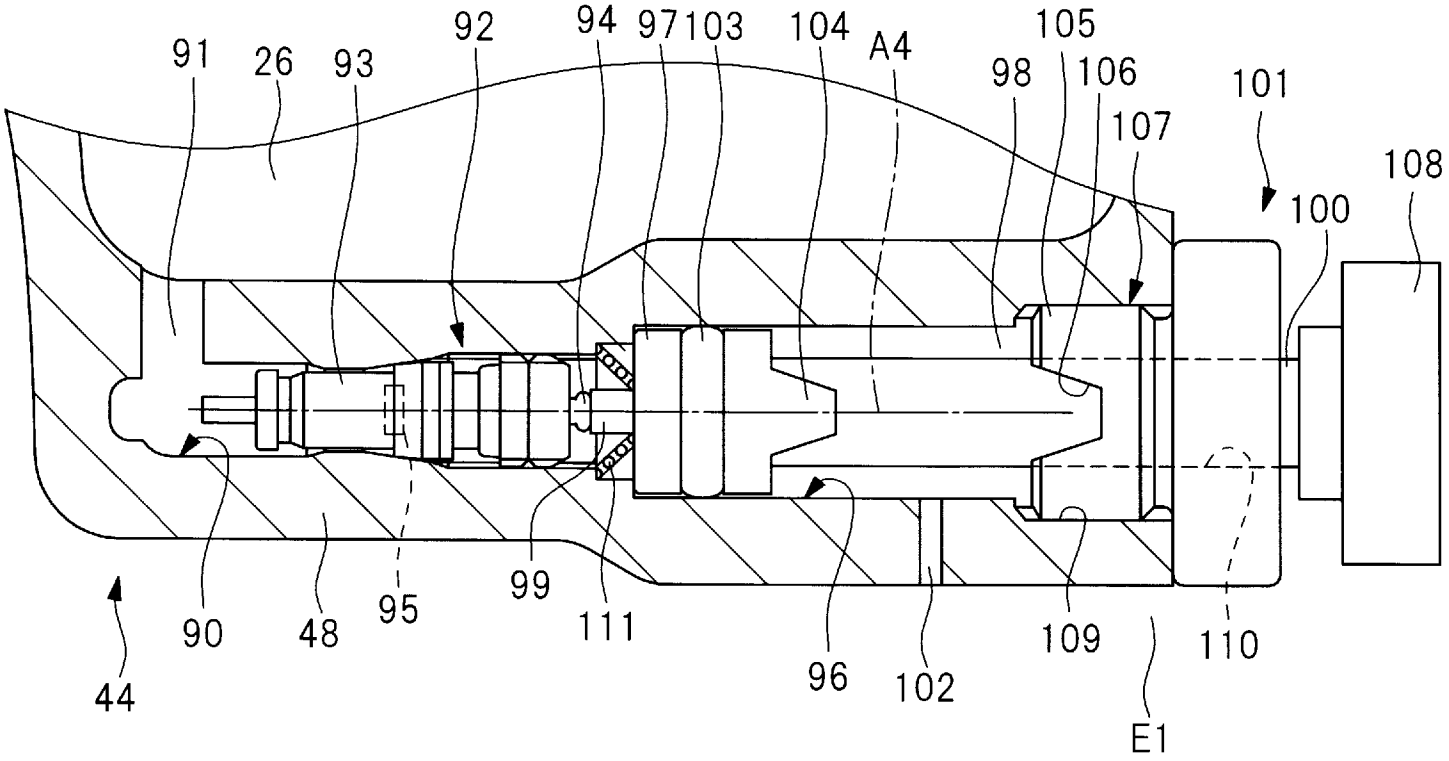
FIG. 18 is a cross-sectional view of a state in which the piston shown in FIG. 16 is at the second operating position.

The examples shown in FIGS. 16, 17 and 18 are obtained by partially modifying the examples shown in FIGS. 13, 14 and 15. An urging member 111 is disposed in the cylinder chamber 98. The urging member 111 urges the piston 97 along the center line A4 in a direction in which the piston 97 is separated from the switching valve 92. The urging member 111 is, for example, a metallic spring.

When the operator uses the driving tool 10, the shaft 100 is not operated as shown in FIG. 16. The piston 97 is urged by the urging member 111, and the tip of the positioning protrusion 104 comes into contact with the tubular part 107, and the piston 97 is stopped at the initial position in the direction of the center line A4.

An operator grasps the knob 108 with a finger and turns the shaft 100 around the center line A4 by a predetermined angle to set the positioning protrusion 104 and the concave part 106 at the same position in the circumferential direction around the center line A1 and stop the shaft 100. Then, the piston 97 operates in a direction away from the switching valve 92 by the urging force of the urging member 111, the positioning protrusion 104 enters the concave part 106 as shown in FIG. 7, and the piston 97 stops at the first operating position.

Further, when the operator applies the manipulation force to the knob 108 to bring the piston 97 to approach the switching valve 92 against the force of the urging member 111, the push pin 99 is pressed against the valve core shaft 94 to open the passage 95 as shown in FIG. 18. When the operator releases the manipulation force applied to the knob 108, the piston 97 is operated in the direction away from the switching valve 92 from the second operating position by the urging force of the urging member 111. Further, the positioning protrusion 104 enters the concave part 106, and the piston 97 stops at the first operating position. After that, the piston 97 is moved back and forth between the first operating position and the second operating position, and the air compressed in the cylinder chamber 98 is supplied to the pressure accumulator 26.

Further, the operator turns the shaft 100 around the center line A4 to set the positioning protrusion 104 and the concave part 106 at different positions around the center line A4, and then stops the shaft 100 and the piston 97 at the initial position, as shown in FIG. 16. As shown in FIG. 15, the positioning protrusion 104 may have a slope 104A and the concave part 106 may have a slope 106A. Then, even if the position of the protrusion 104 and the position of the concave part 106 are different from each other in the turning direction of the shaft 100 centering on the center line A4, since the slope 104A and the slope 106A come into contact with each other, the shaft 100 turns by a predetermined angle, and the protrusion 104 and the concave part 106 are reliably engaged with each other.

Figure 19:
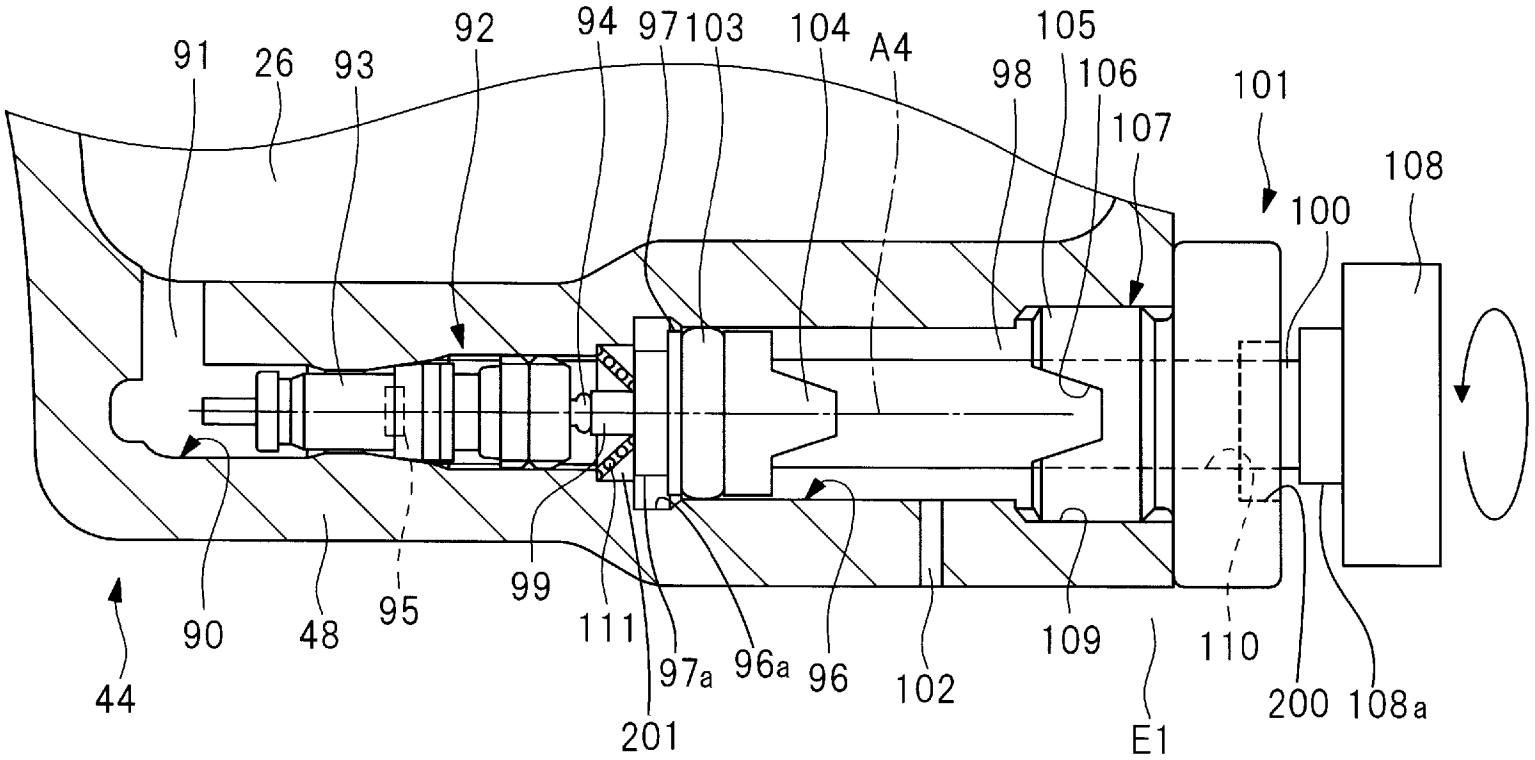
FIG. 19 is a cross-sectional view for explaining an operation in which the compressed air of a pressure accumulator is discharged.

Further, as shown in FIG. 19, the knob 108 is provided with a convex part 108*a*, and further, the cap 101 provided on the mount 48 is provided with a concave part 200. At the time of a work in which the knob 108 is operated to supply the compressed air to the pressure accumulator, the convex part 108*a* and the concave part 200 are prevented from engaging with each other, such that the compressed air in the pressure accumulator 26 does not escape, even if the convex part 108*a* of the knob 108 abuts against the end part of the cap 101. When the pressure of the pressure accumulator 26 is adjusted, after turning the knob 108 so that the convex part 108*a* and the concave part 200 may be engaged with each other, the knob 108 is pushed in and a small diameter part 97*a* of the piston 97 is moved to the space 201. Thus, the seal member 103 moves to a large diameter part 96*a* of the mounting hole 96, the push pin 99 is pressed against the valve core shaft 94 to set the passage 95 in an open state, the seal between the seal member 103 and the inner surface of the mounting hole 96 is released, and the compressed air of the pressure accumulator 26 is discharged from the passage 102 to the atmosphere. The urging member 111 may not be provided.

In the examples shown in FIGS. 16, 17, and 18, the piston 97 and the shaft 100 operates from the second operating position to the first operating position by the urging force of the urging member 111. Therefore, the operator's operation can be simplified. Other operational effects of the examples shown in FIGS. 16, 17 and 18 are the same as those of the examples shown in FIGS. 13, 14 and 15.

Further, when the air compressed in the cylinder chamber 98 is supplied to the pressure accumulator 26 in the state in which the striking part 12 is stopped at the bottom dead center, the striking part 12 does not move while the air pressure of the pressure accumulator 26 increases. Therefore, the hitting energy of the striking part 12 after completion of the supply of air to the pressure accumulator 26 is stable.

In the examples shown in FIGS. 13, 14, 15, 16, 17, and 18, it is also possible to supply air compressed in the cylinder chamber 98 to the pressure accumulator 26, in the state in which the striking part 12 is stopped at a position different from the bottom dead center. Even in this case, it is possible to prevent the pressure of the pressure accumulator 26 from exceeding the required pressure, in the state in which the striking part 12 is located at the top dead center. Therefore, the hitting energy applied to the nail 41 by the striking part 12 can be suppressed from exceeding the target energy.

The contents disclosed in the embodiments and the drawings include some subjects described below. These subjects define contents including a partial configuration among the contents disclosed in the embodiment and drawings, as a driving tool, respectively.

(Subjects included in the examples subsequent to FIG. 13 in addition to FIG. 1 and FIG. 2,) A driving tool which has a pressure accumulator which accumulates a compressible gas, a striking part which operates in a first direction to strike a fastener with a pressure of the compressible gas, and a driving part which operates the striking part in a second direction opposite to the first direction to increase the pressure of the pressure accumulator, in which the driving tool has a pressure chamber which is capable of accommodating the compressible gas to be supplied to the pressure accumulator; a casing which forms the pressure accumulator and the pressure chamber; a movable member which is provided in the casing and operable to reduce a volume of the pressure chamber; and a switching valve which is capable of connecting and blocking the pressure chamber and the pressure accumulator, the movable member being operable in a state in which the striking part is stopped.

(Subjects included in the examples of FIGS. 7 to 12 in addition to FIGS. 1, 2 and 4) A driving tool which has a pressure accumulator which accumulates a compressible gas, a striking part which operates in a first direction to strike a fastener with a pressure of the compressible gas, and a driving part which operates the striking part in a second direction opposite to the first direction to increase the pressure of the pressure accumulator, in which the driving tool has an auxiliary pressure accumulator which is connected to the pressure accumulator and accumulates the compressible gas to be supplied to the pressure accumulator, and a one-way valve which is able to supply the compressible gas of the auxiliary pressure accumulator to the pressure accumulator, and prevents the compressible gas of the pressure accumulator from returning to the auxiliary pressure accumulator, when the pressure accumulator is a predetermined pressure or more, the one-way valve blocks the pressure accumulator and the auxiliary pressure accumulator, and when the pressure accumulator is less than the predetermined pressure, the one-way valve connects the auxiliary pressure chamber and the pressure accumulator.

An example of the technical meaning of the matters explained in the embodiment is as follows. The driving tool 10 is an example of a driving tool, and the pressure accumulator 26 is an example of a pressure accumulator. The first direction D1 is an example of a first direction, the second direction D2 is an example of a second direction, and the striking part 12 is an example of a striking part. The electric motor 15 and the conversion part 17 are an example of a driving part. The auxiliary pressure accumulator 73 is an example of the auxiliary pressure accumulator. The first valve accommodation part 50, the passage 51, and the passage 66 are an example of the first passage. The one-way valve 54 is an example of a one-way valve. The auxiliary valve 61 is an example of the auxiliary valve. The sub tank 19 is an example of an auxiliary container. The piston 71 is an example of a wall part. The urging member 75 is an example of an urging member. The second passage 61A is an example of the second passage. The exhaust hole 76 is an example of a third passage. The valve core shaft 63 is an example of a movable piece. The plunger 57 is an example of a second valve body and a third valve body. The direction of the center line A2 or the direction of the center line A3 is an example of an operating direction of a movable piece, and is also an example of an operating direction of the second valve body and the third valve body.

The space 74 is an example of an accommodation chamber. The air hole 77 is an example of an opening part. The piston 71, the seal member 72, and the exhaust hole 76 are an example of a leak valve. The target pressure is an example of a predetermined pressure. The exhaust hole 76 is an example of a passage. The housing 11 is an example of a housing. The head cover 22 is an example of a lid part. The control part 42 and the position detection sensor are an example of a detection part. The position of the striking part 12 at which the piston 27 comes into contact with the bumper 30 in the direction of the center line A1 is an example of a bottom dead center of the striking part. The nail 41 is an example of a fastener.

Each of the cylinder chamber 98 and the auxiliary pressure accumulator 73 is an example of a pressure chamber. The main tank 18 is an example of a casing. The pistons 71 and 97 are examples of movable members. Each of the switching valve 92 and the one-way valve 54 is an example of a switching valve. The third direction B1 is an example of a third direction, and the fourth direction B2 is an example of a fourth direction. The outside E1 is an example of an outside of the casing. The passage 102 is an example of an auxiliary passage.

A state in which the piston 97 operates in the third direction B1 and the switching valve 92 connects the pressure accumulator 26 and the cylinder chamber 98 is an example of a first operating state. A state in which the piston 97 operates in the fourth direction B2 and the switching valve 92 blocks the pressure accumulator 26 and the cylinder chamber 98 is an example of a second operating state. The valve core shaft 94 is an example of a first valve body.

The driving tool is not limited to the above-mentioned embodiment, and various modifications can be made without departing from the spirit of the invention. For example, in FIGS. 7, 10 and 11, the exhaust hole 76 may not be provided. In the example having the piston 71, it is also possible to provide an adjusting mechanism capable of manually moving the piston 71 from the outside E1 of the sub tank 19 in the direction of the center line.

The electric motor may be a brushed motor or a brushless motor. The power supply part of the electric motor may be either a DC power supply or an AC power supply. The power supply part includes one that is detachable from the housing and one that is connected to the housing via a power cable. The power supply part may be a primary battery instead of the secondary battery.

The driving part that operates the striking part in the second direction includes a motor, a speed reduction mechanism, and a conversion part. The motor includes a hydraulic motor, a pneumatic motor, and an engine, in addition to the electric motor.

The conversion part includes a rack and pinion mechanism, a traction mechanism, and a cam mechanism. The traction mechanism transmits the turning force of the motor to the striking part via the cable, and pulls the striking part to move the striking part in the second direction. The cam mechanism is a mechanism in which an annular cam surface having a gently changed outer diameter is formed in a turning element turned by the turning force of the motor.

The turning element that transmits the turning force of the motor to the conversion part includes a gear, a pulley, a roller, a carrier of a planetary gear mechanism, and a disc member.

The pressure accumulator is a space that accommodates a compressible gas, and is formed in a container such as a tank or a casing. The first passage, the second passage, and the third passage are passages through which the compressible gas flows, and include a hole, an openings part, a gap, a space, a port, and the like. The compressible gas may pass through the auxiliary valve, when the striking part is at the bottom dead center in the operation direction.

In the examples shown in FIGS. 13, 14, 15, 16, 17, and 18, although the holding hole 90, the mounting hole 96, the switching valve 92, the cylinder chamber 98, and the piston 97 are provided in the mount 48, it is also possible to attach another tubular member to the mount 48 and to provide the holding hole 90, the mounting hole 96, the switching valve 92, the cylinder chamber 98, and the piston 97 in the tubular member.

The center line A4 shown in FIGS. 13, 14, 15, 16, 17, and 18 is an example which intersects the center line A1 shown in FIGS. 1 and 6, for example, at an angle of 90 degrees. Further, the center line A4 and the center line A1 may intersect each other at an angle different from 90 degrees. Further, the center line A4 and the center line A1 may be disposed in parallel.

The invention claimed is:

1. A driving tool, including a pressure accumulator which accumulates a compressible gas, a striking part which operates in a first direction to strike a fastener with a pressure of the compressible gas, and a driving part which operates the striking part in a second direction opposite to the first direction to increase a pressure of the pressure accumulator, the driving tool comprising:

a pressure chamber, capable of accommodating the compressible gas to be supplied to the pressure accumulator;

a casing, configured to form the pressure accumulator and the pressure chamber;

a movable member, provided in the casing and capable of being operated to reduce a volume of the pressure chamber; and a switching valve, capable of opening and closing a connection between the pressure chamber and the pressure accumulator, wherein the movable member is capable of being operated in a third direction in which the volume of the pressure chamber is reduced, and in a fourth direction which is opposite to the third direction and in which the volume of the pressure chamber is increased, wherein the switching valve has a first valve body which operates to open and close the connection between the pressure chamber and the pressure accumulator, and the driving tool further comprises:

a first operating state in which the first valve body operates to open the connection between the pressure chamber and the pressure accumulator by operating the movable member in the third direction to come into contact with the first valve body, and a second operating state in which the first valve body operates to close the connection between the pressure chamber and the pressure accumulator by operating the movable member in the fourth direction and separating from the first valve body.

2. The driving tool according to claim 1, wherein, the compressible gas of the pressure accumulator is released by manipulating the movable member to maintain a state of being in contact with the first valve body and releasing a sealing of a seal member.

3. A driving tool, including a pressure accumulator which accumulates a compressible gas, a striking part which operates in a first direction to strike a fastener with a pressure of the compressible gas, and a driving part which operates the striking part in a second direction opposite to the first direction to increase a pressure of the pressure accumulator, the driving tool comprising:

a pressure chamber, capable of accommodating the compressible gas to be supplied to the pressure accumulator;

a casing, configured to form the pressure accumulator and the pressure chamber;

a movable member, provided in the casing and capable of being operated to reduce a volume of the pressure chamber; and a switching valve, capable of opening and closing a connection between the pressure chamber and the pressure accumulator, wherein the movable member is capable of being operated in a third direction in which the volume of the pressure chamber is reduced, and in a fourth direction which is opposite to the third direction and in which the volume of the pressure chamber is increased, wherein an auxiliary passage which connects the pressure chamber and an outside of the casing is provided, and the movable member closes the auxiliary passage by operating in the third direction and opens the auxiliary passage by operating in the fourth direction.

4. A driving tool, including a pressure accumulator which accumulates a compressible gas, a striking part which operates in a first direction to strike a fastener with a pressure of the compressible gas, and a driving part which operates the striking part in a second direction opposite to the first direction to increase pressure of the pressure accumulator, the driving tool comprising:

an auxiliary pressure accumulator, connected to the pressure accumulator and accumulating the compressible gas to be supplied to the pressure accumulator;

a first passage, connecting the auxiliary pressure accumulator and the pressure accumulator, and the compressible gas passing through the first passage;

a one-way valve, provided in the first passage and capable of supplying the compressible gas of the auxiliary pressure accumulator to the pressure accumulator, and preventing the compressible gas of the pressure accumulator from returning to the auxiliary pressure accumulator; and an auxiliary valve, connected between the auxiliary pressure accumulator and the one-way valve in the first passage at one side, connectable to an external device which supplies the compressible gas at another side, and the compressible gas to be supplied from the external device to the auxiliary pressure accumulator and the pressure accumulator capable to pass through the auxiliary valve.

5. The driving tool according to claim 4, wherein the one-way valve opens in a condition that a pressure of the pressure accumulator is less than a pressure of the auxiliary pressure accumulator, and closes in a condition that the pressure of the pressure accumulator is equal to or higher than the pressure of the auxiliary pressure accumulator.

6. The driving tool according to claim 4, further comprising:

an auxiliary container, in which the auxiliary pressure accumulator and a space are formed;

a wall part, movably provided inside the auxiliary container, and separating the auxiliary pressure chamber from the space; and an urging member, configured to apply an urging force to the wall part to reduce a volume of the auxiliary pressure accumulator, wherein an operating direction of the striking part intersects a moving direction of the wall part.

7. The driving tool according to claim 4, wherein the auxiliary valve has a second passage connected to the first passage, and a movable piece, operating to open and close the second passage, and by operating the movable piece to open the second passage, the one-way valve connects the pressure accumulator and the first passage with an operating force of the movable piece.

8. The driving tool according to claim 7, wherein the one-way valve has a second valve body, operating in either a direction parallel to the first direction or a direction intersecting the first direction to open or close a connection between the first passage and the pressure accumulator, and an operating direction of the movable piece and an operating direction of the second valve body are the same.

9. The driving tool according to claim 6, wherein the auxiliary container has an accommodation chamber, accommodating the urging member, and an opening part, connecting the accommodation chamber and an outside of the auxiliary container, and the urging member is a mechanical spring.

10. The driving tool according to claim 6, wherein a leak valve which connects the auxiliary pressure accumulator to an outside of the auxiliary container and blocks the auxiliary pressure accumulator from the outside of the auxiliary container is provided, and in a condition that a pressure of the auxiliary pressure accumulator is equal to or lower than a predetermined pressure, the leak valve blocks the auxiliary pressure accumulator from the outside of the auxiliary container, and in a condition that the pressure of the auxiliary pressure accumulator exceeds the predetermined pressure, the leak valve connects the auxiliary pressure accumulator and the outside of the auxiliary container.

11. The driving tool according to claim 10, wherein the leak valve has a third passage which penetrates an inside and the outside of the auxiliary container, and the wall part which opens and closes the third passage.

12. The driving tool according to claim 11, wherein the third passage generates a sound in a condition that the compressible gas of the auxiliary pressure accumulator flows to the outside of the auxiliary container.

13. The driving tool according to claim 4, wherein the one-way valve has a third valve body which operates to open or close a connection between the pressure accumulator and the first passage, and an operating direction of the striking part is parallel to an operating direction of the third valve body.

* * * * *